US009097005B2

(12) United States Patent
Cave et al.

(10) Patent No.: US 9,097,005 B2
(45) Date of Patent: Aug. 4, 2015

(54) LOFT FLOORING SYSTEM

(71) Applicants: Piers St. John Spencer Galliard Cave, Woking (GB); Paul Andrew Godfrey, New Bridge House (GB); David John Lennan, London (GB)

(72) Inventors: Piers St. John Spencer Galliard Cave, Woking (GB); Paul Andrew Godfrey, New Bridge House (GB); David John Lennan, London (GB)

( * ) Notice: Subject to any disclaimer, the term of this patent is extended or adjusted under 35 U.S.C. 154(b) by 0 days.

(21) Appl. No.: 13/771,977

(22) Filed: Feb. 20, 2013

(65) Prior Publication Data

US 2013/0239492 A1 Sep. 19, 2013

Related U.S. Application Data

(63) Continuation-in-part of application No. PCT/GB2011/001022, filed on Jul. 6, 2011.

(30) Foreign Application Priority Data

Aug. 20, 2010 (GB) ..... 1013999.6
Jan. 26, 2011 (GB) ..... 1101366.1

(51) Int. Cl.

| | |
|---|---|
| ***E04B 5/00*** | (2006.01) |
| ***E04B 7/00*** | (2006.01) |
| ***E04B 5/43*** | (2006.01) |
| ***E04F 15/024*** | (2006.01) |
| ***E04B 5/12*** | (2006.01) |
| ***E04B 5/48*** | (2006.01) |

(52) U.S. Cl.

CPC ... *E04B 5/43* (2013.01); *E04B 5/12* (2013.01); *E04B 5/48* (2013.01); *E04F 15/02452* (2013.01); *E04F 15/02458* (2013.01)

(58) Field of Classification Search

CPC ..... E04F 15/02452; E04F 15/02458; E04B 5/43; E04B 5/48; E04B 5/12; H02G 3/0608

USPC ..... 52/220.5, 220.6, 263, 289, 408, 506.06

See application file for complete search history.

(56) References Cited

U.S. PATENT DOCUMENTS

| | | | | |
|---|---|---|---|---|
| 3,316,680 | A * | 5/1967 | Chrastek | 52/126.6 |
| 4,712,309 | A * | 12/1987 | Kingston et al. | 33/527 |
| 5,197,251 | A * | 3/1993 | Krysak | 52/407.3 |
| 5,564,658 | A * | 10/1996 | Rinderer | 248/58 |
| 5,638,914 | A * | 6/1997 | Kizzia | 182/45 |
| 5,868,361 | A * | 2/1999 | Rinderer | 248/58 |
| 6,061,984 | A * | 5/2000 | Rose | 52/220.1 |
| 6,547,192 | B2 * | 4/2003 | Rinderer et al. | 248/49 |
| 7,591,105 | B2 * | 9/2009 | Balser | 52/29 |

(Continued)

*Primary Examiner* — Brian Glessner
*Assistant Examiner* — Paola Agudelo
(74) *Attorney, Agent, or Firm* — Invention To Patent Services; Alex Hobson

(57) ABSTRACT

The present invention provides a loft flooring system that, inter alia, comprises: a plurality of bridging supports each adapted to bridge between a substantially parallel pair of joists of a loft floor and having a first upright leg with a foot to mount onto a first of the joists and having, in use, a second upright leg with a foot to mount onto a second of the joists, and a spanning element therebetween defining a flooring surface or onto which flooring boards or flooring panels are laid, wherein each leg is initially separate and the spanning element is an initially separate beam that is mounted to the legs to span between the joists. The system is comparatively straightforward and efficient to install and, where needed, uninstall and also is robust and stable. With special support arms on the legs or hung from the spanning element it can also greatly facilitate discrete management of pipe-work and cabling below the raised floor too.

33 Claims, 15 Drawing Sheets

(56) References Cited

U.S. PATENT DOCUMENTS

| | | | | |
|---|---|---|---|---|
| 8,434,275 | B2 * | 5/2013 | Hashimoto et al. | 52/126.6 |
| 2002/0116880 | A1 * | 8/2002 | Greenblatt | 52/126.2 |
| 2005/0258722 | A1 * | 11/2005 | Sullivan | 312/245 |
| 2005/0284040 | A1 * | 12/2005 | Hashimoto et al. | 52/126.1 |
| 2010/0133216 | A1 * | 6/2010 | Lanza-Brache et al. | 211/86.01 |
| 2011/0283644 | A1 * | 11/2011 | Barry et al. | 52/480 |
| 2013/0133282 | A1 * | 5/2013 | Cave et al. | 52/650.1 |
| 2013/0232891 | A1 * | 9/2013 | Ferguson | 52/126.5 |

* cited by examiner

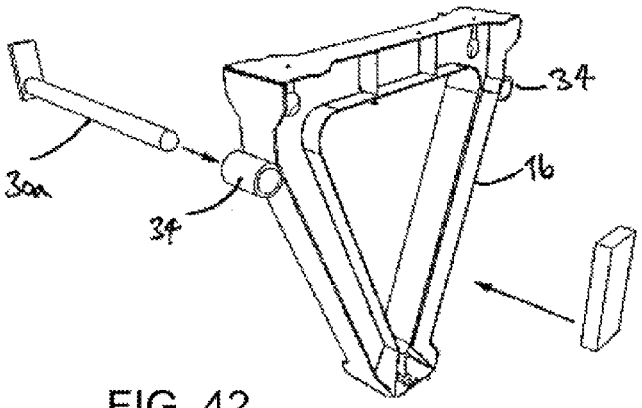
FIG. 42
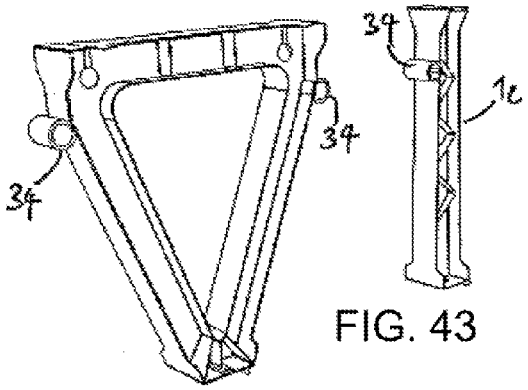
FIG. 43
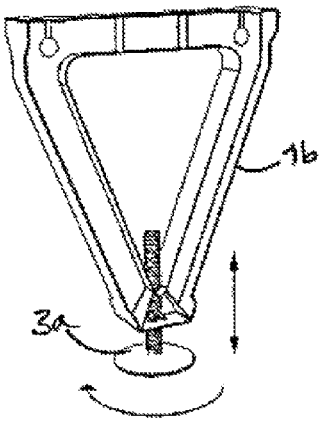
FIG. 44
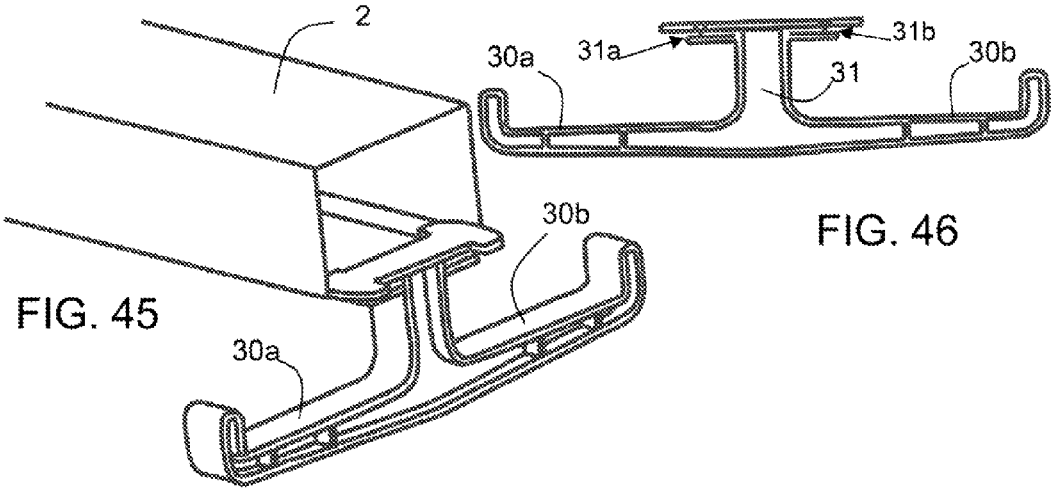
FIG. 46
FIG. 45

LOFT FLOORING SYSTEM

CROSS REFERENCE TO RELATED APPLICATIONS

This application is a continuation in part of PCT Application Number: PCT/GB2011/001022 filed on Jul. 6, 2011 and entitled Loft Flooring System, which claims priority to GB 1101366.1 filed on Jan. 26, 2011 and entitled Loft Flooring System, and GB 1013999.6 filed on Aug. 20, 2010 and entitled Loft Flooring System, all of which are incorporated herein by reference in their entirety.

FIELD OF THE INVENTION

The present invention concerns improvements in and relating to loft flooring systems that are adapted to preserve the recommended depth of loft insulation material in the loft when laying the flooring.

BACKGROUND TO THE INVENTION

Energy efficiency of buildings is a pressing issue that now affects us all. There is increasingly widespread appreciation of the need for better building insulation to combat thermal energy wastage and its associated costs to the environment as well as the direct cost to the property owner or tenant. Alongside cavity wall insulation, loft insulation is the major target for improvement in many homes and a key feature or recommendation point in the now statutory energy efficiency survey that accompanies all residential property transactions in the UK.

UK government and building industry recommendations are for a 270-300 mm depth of insulation material to be laid in the loft/attic between the joists of the loft/attic floor to reduce loss of inexorably rising internal heat into the loft space and out through the roof. Indeed, Part L of the current UK Budding Regulations requires a depth of at least 250 mm. Since most joists (also known as ceiling ties) are 75 mm or 100 mm deep, in general the insulation will need to rise 200 mm or more above the top of the joists and thus any flooring subsequently laid over the joists will generally compact the insulation back down by that difference in depth. Such compaction greatly reduces the effectiveness of the insulation, which relies on being un-compacted in order to trap air in pockets and thus should be avoided.

In the case of installing permanent loft flooring in the manner of a loft conversion, turning the loft into proper living space, the issue is normally avoided/addressed by transferring the insulation capability from the floor to the rafters of the roof instead. However, for the more temporary loft is flooring that is often installed by home-owners themselves to serve as a platform for storage of belongings in the loft there will generally not be an obligation or desire to expensively line the roof in place of the loft floor.

The compaction of the loft floor insulation is generally ignored until flagged up in a subsequent energy efficiency survey carried out prior to sale of the property. However, this is of course, very energy wasteful and the problem has inspired some consideration in the industry. A primary proposal for addressing the problem is to lay an array of mutually parallel boards/battens edge-on on top of the joists running orthogonal to the joists and to be nailed down to the joists to provide a raised floor with the insulation filled firstly between the joists and then between the battens. This system is time-consuming to install and, if needed, also time-consuming to uninstall and the upper part of the insulation either needs to be laid separately or be locally crushed where the battens run.

A further proposal to address the compaction problem is outlined in GB 2438620A (Milner) and entails provision of box beam spacers that are again laid on top of the joists running orthogonal to the joists and to be nailed down with blocks to the joists. With this latter system the box beam spacers are specially constructed having a rectangular box form with opposing sidewalls and top and bottom walls and to achieve the required insulation depth using the system the insulation material must be inserted into the rectangular box form. This system lacks versatility and although it is somewhat less time-consuming to install than the other prior systems it is rendered awkward by the need to fill the insulation firstly between the joists and then into the spacers and between the spacers rather than simply laying it between the joists.

It is a general object of the present invention to provide a new system and method for laying a loft floor to address the problem of insulation compaction and which is comparatively straightforward and efficient to install and, where needed, uninstall.

In the existing loft raised floor systems further problems arise when seeking to accommodate for any services conduits such as electrical cables for mains power sockets or for lighting or pipe-work (eg for water supply pipes/central heating pipes) that cross the floor. It is a general object of the present invention to provide a system and method for laying a raised floor/loft floor to address the problem of insulation compaction and which also provides for versatile, secure, efficient and cost-effective installation and management of services conduits.

SUMMARY OF THE INVENTION

According to a first aspect of the present invention there is provided a loft flooring system that comprises: a plurality of bridging supports each adapted to bridge between a substantially parallel pair of joists of a loft floor and having a first upright leg with a foot to mount onto a first of the joists and having, in use, a second upright leg with a foot to mount onto a second of the joists, and a spanning element therebetween over which flooring boards or flooring panels are laid, wherein each leg is initially separate and the spanning element is an initially separate beam that is mounted to the legs to span between the joists.

Preferably each leg has an integral spanning element portion that extends from an upper end of the leg and towards the other leg in use on which the beam may rest.

Preferably the foot of each leg extends from the leg in at least one direction, and preferably both directions, along the corresponding joist to which it is mounted in use. In other words the foot of each leg suitably extends in at least one direction substantially orthogonal to the spanning element portion of the leg.

The flooring system is particularly preferably installed as a plurality of rows each traversing the joists, the rows parallel to each other but not structurally inter-connected save for the flooring boards or panels that overlie them in use—ie having no spanning element or other support member for the floor extending from one row to the next.

The described system assembled from legs and beams in rows traversing the joists is remarkably quick to install and is stable and safe. By contrast, we have found that simpler arrangements that use arrays of legs as pedestals for direct support of flooring panels/boards without use of the beams or which have beams that extend longitudinally of the joists but not traversing them are generally unstable and unsafe and vulnerable to catastrophic collapse. Furthermore, more complex inter-connected arrangements, where the rows spanning joists are inter-linked by extra spanning elements or other support members for the floor fitted extending from one row to the next (eg rectangular table type framework arrangements) are not only more expensive and more time-consuming to install but also can interfere with the laying of loft insulation transverse to the joists and may necessitate raising the flooring level exceptionally high wasting loft space.

Particularly preferably the spanning element that spans between the joists is a separate spanning element formed as rigid elongate member that sits or otherwise mounts at one end onto a spanning element portion of the first leg and at the other end onto a spanning element portion of the second leg.

In a preferred embodiment the spanning element has male or female sliding engagement means for sliding inter-engagement with complementary sliding engagement means on each of the first leg and second leg. Preferably the male sliding engagement means comprises a flange and which preferably is provided along at least one longitudinal edge (suitably both longitudinal edges) of the spanning element, while the female sliding engagement means comprises a corresponding slot in each of the first leg and second leg at/near the upper end thereof. This sliding inter-engagement arrangement provides even greater security to the system and also assists good alignment of the legs.

The spanning element portion of each leg suitably projects over the void between joists. The arrangement of each leg and foot stabilizes the leg in use.

Preferably the spanning element sits onto the spanning element portion of each leg and may be adjusted in span simply by adjusting the extent of overlap of one end, or each end, of the spanning element on the respective spanning element portion. Suitably the spanning element has at at least one end an aperture for a screw or other fixing therethrough for the end to be fixed in place to the spanning element portion of the leg. To allow for adjustment, one or each end of the spanning element preferably has an elongate slot or series of apertures for a nail or other fixing therethrough.

Preferably the spanning element is cold roll formed but may also suitably be cast or extruded from a metal or alloy (preferably steel) as a channel profiled form. Particularly preferably the spanning element has a U-shaped profile and mounts inverted onto the spanning element portion of each of the first and second legs.

Each leg preferably is bifurcated or has at least two sterns each extending between the foot of the leg and the spanning element portion of the leg. One stem suitably supports a first end of the spanning element portion while another stem supports a second end of the spanning element portion. Preferably the leg is bifurcated, slitting into two diverging sterns at or near the foot. Preferably each spanning element portion is integral to the upper end of the corresponding leg.

Preferably the upper end of each leg that defines a platform/surface on which the spanning element mounts is formed with a dip/recess into which a nail or other fixing may be driven so that the spanning element may be tightened down onto the platform, compressing into the dip/recess.

Using the system of the present invention the insulation may first be laid between the joists to a depth rising above the joists and the bridging support then mounted in place accommodating the laid insulation thereunder without compaction of the insulation and, furthermore, the system is very quick to install, strong and highly versatile. The system is not a mere support table for loft storage but, rather, is flooring that will safely support the weight of individuals walking upon it.

Preferably the foot of the first and/or second upright leg is formed with a bracket that fits to a top surface and a sidewall of the joist. In one embodiment one of the first and second legs has a foot in the form of such a bracket while the other of the first and second legs has a foot in the form of a plate. Preferably the bracket is provided with a channel profile to fit not only to a top surface and a sidewall of the joist but to the opposing sidewall too as a saddle. In each case the fit of the bracket to that joist limits or substantially prevents movement of the bridging support in either direction orthogonal to the joists. The part of each bracket that fits to a said top surface of a joist extends from the leg in each direction lengthwise of the joist and provides support against toppling in a direction lengthwise of the joist. The configuration of the bridging supports and their feet provide for a high level of stability and security in use.

The span of the bridging support is adapted to conform to the separation of the joists and to form a bridge over the joists with a void between the legs that is aligned with and contiguous with the void/channel between the joists—unlike the prior art which is configured to run orthogonal to the joists/inter-joist channel. This arrangement uniquely allows insulation to be laid between the joists to the required depth rising above the joists and the bridging support then mounted in place accommodating the laid insulation.

The system may suitably further comprise a plurality of panels of particle board/chipboard or fibre-board to overlie the bridging supports above the beams to define the loft flooring.

To assist speedy and accurately positioned/uniform installation a simple elongate fitting tool may be provided having a bar with spaced apart elements along its length at intervals that define the spacing of the feet of the rows along each joist. These elements are suitably fingers that project up the side and/or over the top of the joist while the bar is substantially flat up against the side of the joist and the tool suitably has an integral clamp for securing the tool to the joist in use. The tool may further have a pair of pivoting alignment bars for rotating to extend orthogonal to the joist to align the legs on the second joist with those on the first joist.

According to a second aspect of the present invention there is provided a method of laying loft flooring and insulation that comprises: providing a plurality of bridging supports each adapted to bridge between a substantially parallel pair of joists of a loft floor and having a first upright leg and an initially separate second upright leg each leg with a foot to mount onto a joist; and mounting the first leg to one joist and the second leg to the other joist, and mounting a spanning element therebetween defining a support surface onto or above which flooring boards or panels may be laid; and laying insulation to a required depth before or after mounting the bridging supports in place accommodating the laid insulation under the flooring boards or panels laid on the spanning element whereby the insulation remains substantially uncompacted. Preferably insulation is first laid between the joists, suitably to a depth that rises above the joists, and the bridging supports are subsequently mounted in place thereover, bridging between the joists. To complete the insulation of the loft flooring system as installed a breathable sealing tape is preferably applied to cover over the gap between the perimeter of the flooring system and the joist.

According to a further aspect of the present invention there is provided a loft flooring system that comprises: a plurality of bridging supports each adapted to bridge between a substantially parallel pair of joists of a loft floor and having a first upright leg with a foot to mount onto a first of the joists and having, in use, an initially separate second upright leg with a foot to mount onto a second of the joists, and an initially separate spanning element that is mounted thereto to span therebetween and onto which flooring boards or panels can be laid, wherein the foot of the first and/or second upright leg is formed with a right-angled bracket that fits to a top surface and a sidewall of the joist or a formed with a channel profile bracket to fit not only to a top surface and a sidewall of a said joist but to the opposing sidewall too as a saddle whereby the fit of the bracket to that joist limits or substantially prevents movement of the bridging support in a direction orthogonal to the joists, and wherein the foot extends in a direction along the joists.

A support assembly of any desired length can be produced by adding further bridging supports to the last bridging support of the assembly so as to span any number of joists and provide a platform for laying flooring to span between adjacent rows of bridging supports. The bridging supports may all be the same. Alternatively, the bridging supports may include an end support for mounting at one end of a row and main supports for connecting a first said main support to the end support and thereafter connecting a second main support to the first main support and so on until the desired length of support assembly is produced. In use the system further comprises a plurality of flooring panels that overlie the beams of the bridging supports to define the loft flooring.

The span of each bridging support is suitably adapted to conform closely to the separation of the central axes of the joists and to form a bridge over the joists with a void between the legs that is aligned with and contiguous with the void/channel between the joists. Suitably the legs of the bridging supports are spaced apart by a span of 1200 mm or 1800 mm plus or minus up to half the thickness of the joists and the beam is of a corresponding length. In use a said bridging support suitably comprises at least three legs each to mount atop a respective one of a corresponding number of joists.

According to a further aspect of the present invention there is provided a raised flooring system that comprises: a plurality of bridging supports each adapted to bridge between a substantially parallel pair of joists of a floor (particularly preferably a loft floor) and having a first upright leg with a foot to mount onto a first of the joists and having, in use, a second upright leg with a foot to mount onto a second of the joists, and a spanning element therebetween over which flooring boards or flooring panels are laid, wherein the system further comprises a services conduit support hanger that is adapted to engage with and hang from the spanning element.

Preferably the spanning element is an elongate beam with a channel extending therealong and the hanger is adapted to slidingly engage within the channel of the beam to hang therefrom and be slidable along the channel to be positionally adjustable along the length of the beam.

Preferably the beam has a lateral rim/flange along each longitudinal edge of the channel Whereby each rim/flange projects towards the other over the channel and preferably the hanger has a stem and a head that that is larger than the stem and whereby the head is adapted to be held in the channel by the lateral rims/flanges. In one embodiment the hanger may have a stem or head with a pair of grooves, one groove on each side, whereby one of the flanges fits into one of the grooves and the other flange fits into the other of the grooves.

The hanger preferably comprises a stem having at least one and preferably a pair of support arms thereon and where the or each arm provides a support ledge on which pipe-work or cabling may be carried. Where there is a pair of support arms these are preferably arranged with one arm extending from each opposing side of the stem or there may be one arm mounted to the stem in such a way that it projects to each opposing side of the stem. Each arm may be substantially straight/level and with an upturn/lip at the end to laterally retain the pipe-work or cabling in place. The support arm(s) may be de-mountable from the stem and suitably the stem has a socket into which the support arm mounts.

In a particularly preferred embodiment the support hanger comprises at least a first arm or pair of support arms at a first level along the stem and a second arm or pair of support arms at a second level further down the length of the stem. Preferably the second arm or pair of arms is/are longer than the first arm or pair of arms. Having the arms at different levels provides multi-tier support whereby, for example, the upper tier may carry electrical cable while the lower carries a water pipe.

In an alternative preferred embodiment of the invention the hanger may be formed as a saddle having a channel in a lower in use face to fit astride the top and sides of a said spanning element to hang therefrom and the channel of the hanger being slidable along the spanning element for the hanger to be positionally adjustable along the length of the spanning element. The support arms may be integral to the hanger wherein the support arms and hanger are formed by being pressed and folded from a sheet or extruded as a unitary body.

In a further aspect of the present invention there is provided a raised support system or raised flooring system that comprises: a plurality of support legs adapted to raise services conduits to bridge between a substantially parallel pair of joists of a floor and having a first upright leg with a foot to mount onto a first of the joists and having, in use, a second upright leg with a foot to mount onto a second of the joists, wherein the system further has at least one services conduit support arm projecting from at least one of said legs. Preferably the services conduit support arm is positioned below the top of the leg to provide a support ledge on which pipe-work or cabling may be carried below the level of the floor. The leg may have a pair of support arms arranged with one arm extending from each opposing side of the stem or one arm that projects to each opposing side of the stem. The, or each, arm may be substantially level and with an upturn/lip at the outer end to laterally retain the pipe-work or cabling in place. The leg may have a first support arm or pair of support arms at a first level along the leg and a second arm or pair of support arms at a second level further down the length of the leg. Here preferably the second arm or pair of arms is/are longer than the first arm or pair of arms.

BRIEF DESCRIPTION OF THE DRAWINGS

Embodiments of the present invention will now be further described, by way of example only, with reference to the accompanying drawings, in which:

FIG. 4 shows a first support leg of the preferred embodiment, the integral partial spanning portion extending in both inter joist spanning directions to suit use of the leg on joists away from the loft edges, while

FIG. 11 shows raised cable guides/supports within the track, while

FIG. 21 shows the tool being lowered to mount to a first joist, while

FIG. 29 is a perspective view of a pair of support legs and spanning beam of the system, while

FIG. 35 is a perspective view of a variant of the FIG. 28 system wherein the two tier services conduit support hanger is cast or moulded as a one-piece construction and FIG. 36 is a detailed view of that hanger, while

FIG. 42 shows demountability of the arms of the services conduit support from sockets on the leg, FIG. 43 shows a single (non-bifurcated) support leg with an integral socket for conduit support arms;

FIG. 44 is a detailed view of a raised floor support leg that has an integral extension foot that may be screwed up or down to raise or lower the height of the leg; and FIG. 45 is a perspective view of a further variant of the services conduit support hanger being mounted to the channel-shaped beam and FIG. 46 shows this further variant in end elevation, emphasizing grooves along the sides of the head of the hanger which secure the hanger to the beam.

DESCRIPTION OF THE PREFERRED EMBODIMENTS

Figure 1:
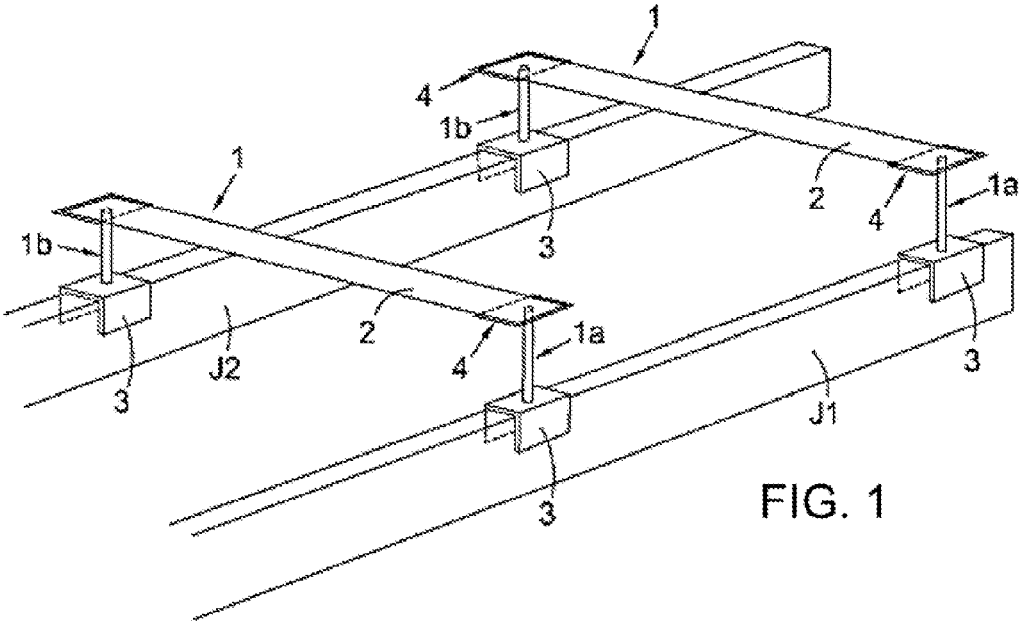
FIG. 1 is a perspective view of a first embodiment of the bridging support of the system from a first end shown in situ mounted spanning a pair of loft floor joists, the flooring support system being based on a set of individual legs that when paired up and used with a spanning element comprising a plank or beam function as a bridging support in use.

Referring firstly to FIG. 1, the flooring system comprises a plurality of bridging supports 1 mounted in rows, each row bridging the joists J1, J2 of the loft floor. Each bridging support 1 comprises a pair of initially separate pedestal-type legs 1*a*, 1*b* assembled with an overlying spanning element 2 in the form of a metal or timber beam spanning between the tops of the legs 1*a*, 1*b*.

Each leg 1*a*, 1*b* of the bridging support 1 comprises a slim but sturdy pillar or pole upright member and that has a foot 3 by which it is mounted to a respective one of a substantially parallel pair of the loft floor joists J1, J2. The foot 3 in FIG. 1 is formed as a saddle, or inverted channel shaped bracket, structure that fits over the top surface and both sidewalls of the respective joist J1, J2 on which it is mounted so that the fit of the foot 3 to that joist J1, J2 limits or substantially prevents movement of the bridging support 1 in both directions orthogonal to the joist J1, J2. In a variation to this shown in FIG. 1A the foot 3 may be formed as a right-angled bracket that fits to a top surface and one sidewall only of the joist J1, J2. The foot of each leg 1*a*, 1*b* notably extends from the leg in both directions along the corresponding joist to which it is mounted in use and which greatly enhances stability and sturdiness of the support. Once fitted in place, the foot is suitably railed to the joist J1, J2.

The legs 1*a*, 1*b* may be formed as a plastics moulding of nylon, polypropylene, HDPE or other strong plastics, optionally reinforced with fiberglass, steel or other reinforcing material with the assembled and installed bridging support 1 formed from those legs being strong enough to bear double the weight of a 70 kg individual standing upon it.

For most houses constructed in the UK from the 1960s onwards the roof structure incorporates trusses and in such trussed roofs the loft joists' central axes are normally 600 mm apart. The span of the bridging support 1 for such lofts should conform to that and thus be approximately 600 mm too or be a multiple of 600 mm where it spans over two or more inter-joist channels.

For optimal strength and security the centres of the legs 1*a*, 1*b* are suitably substantially aligned with the central axes of the joists J1, J2 and thus, in this example also of a 600 mm span. However, there is some freedom either side of this but suitably limited by the thickness of the joists so that the leg/wall will bear directly down onto the joist to which it is mounted. Since the joists are generally of the order of 35 to 50 mm thick the span of the bridging support might be up to 25 mm more or less at each end, ie between 550 to 650 mm span, but preferably is 600 mm. The length of the spanning element 2 is selected to conform to the span to be covered, is corresponds to the separation of the joists J1, J2, to form the bridge over the joists J1, J2. For older properties, or those that otherwise lack trusses, the commonest spacing between the loft joists' central axes is 430 mm apart. The span of the bridging support for such lofts should suitably conform to that and thus be approximately 430 mm too. For each other different standard spacing between the loft joists' central axes a respective tailored bridging support span may be provided.

The tops of the pedestal legs 1*a*, 1*b* are hereshown as having rectangular flat plates 4 that project in a horizontal plane beyond the tops of the legs 1*a*, 1*b* to provide a flat platform on which the spanning element/beam 2 is laid and on which spanning element/beam 2, in turn, the flooring boards or panels are laid. The platform 4 serves as a spanning element portion 4 of the leg 1*a*, 1*b* that extends from an upper end of the leg upright and projects towards the other leg in use. The spanning element portion 4 can rest on this platform 4 at a range of positions somewhat fore and aft of the leg upright and even slightly overhanging beyond the edge of the joist J1, J2. This arrangement provides more flexibility/tolerance in the system to allow for a few centimeters variance in spacing between the joists J1, J2 without need for use of a telescopic/length adjustable spanning element between each leg 1*a*, 1*b*.

The flooring boards or panels of chipboard, fibre-board or other suitable flooring material are laid on top of the bridging supports 1 on the platform 4 of the spanning element 2 and each extend over to the spanning element 2 of the next parallel row of bridging supports 1 row farther along the joist J1, J2.

Figure 1A:
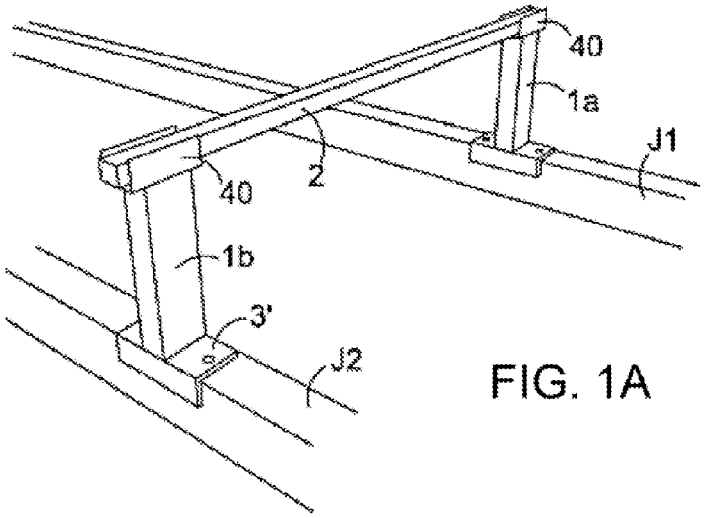
FIG. 1A shows a variant of the first embodiment in which the spanning element is cradled by the legs and in which each legs stand on a foot that has the form of a right-angled bracket.

In the variant of the first embodiment illustrated in FIG. 1A, each leg 1*a*, 1*b* of the bridging support 1 has a cradle 40 at its upper end rather than a simple platform 4. The cradle 40 accommodates the spanning element/beam 2 to support the flooring panels, screwed, nailed or otherwise fixed to the beam 2. The cradle 40 has a channel that constrains the spanning element/beam 2 laterally, ie in the directions parallel to the joists J1, J2 but still allows the spanning element/beam 2 to be shifted in the direction orthogonal to the joists so that the end of the spanning element/beam 2 may be adjusted in extent of overlap on the cradle 40 if required.

Each beam/spanning element 2 end may abut a stop shoulder on a cradle 40 or platform 4 of the leg 1*a*, 1*b* to maintain spacing between legs 1*a*, 1*b* and suitably is screwed, nailed or otherwise fixed to the cradle 40 or platform 4. The beam/spanning element 2 may be demounted or re-positioned as desired.

Figure 2:
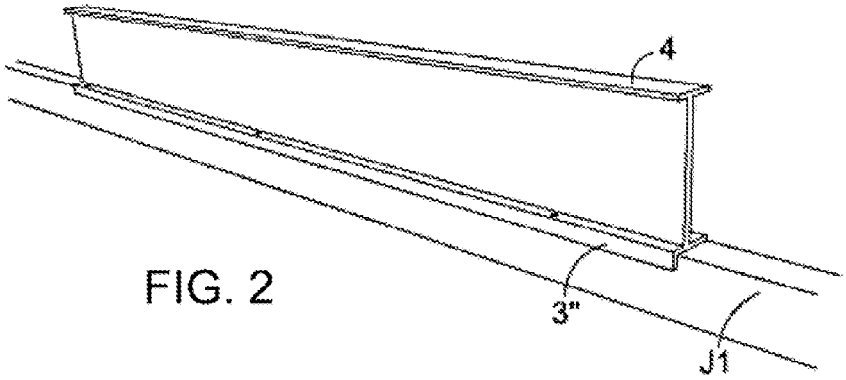
FIG. 2 is a perspective view of a variant of the individual leg arrangement of FIG. 1, in which each leg is in the form of an elongate beam running for a substantial distance lengthwise of the joist
Figure 13:
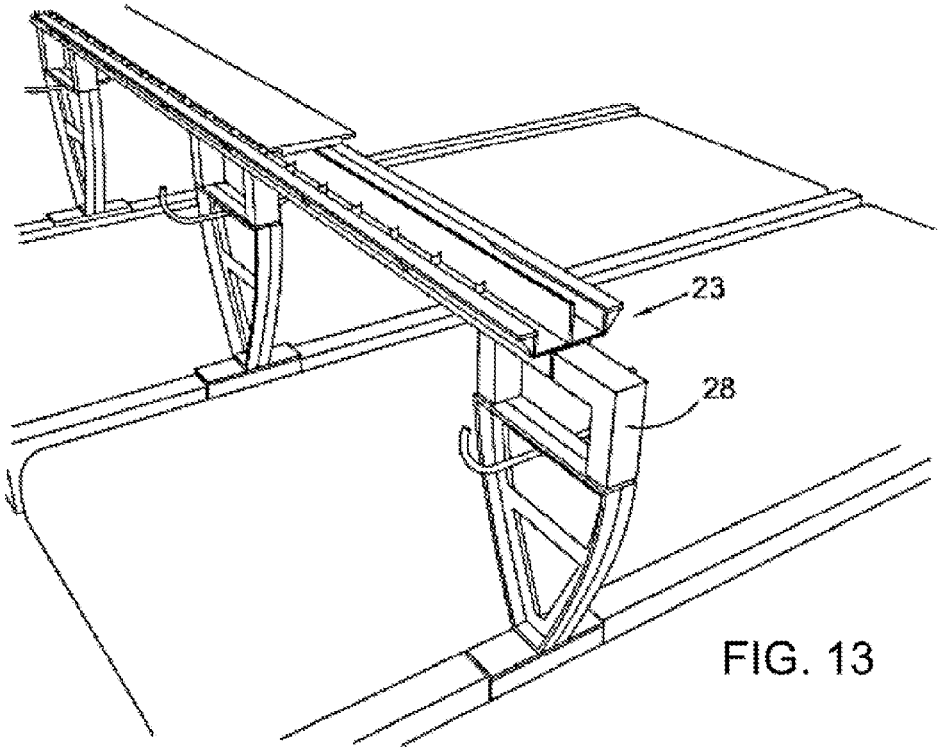
FIG. 13 shows use of an arch extension to the top of the leg to raise the cable-carrying spanning element, while this is further shown in FIG. 14 which also shows the demountability of the support brackets or hooks for the under hung pipe-work.

Turning now to FIG. 2, this shows a variant of the independent leg arrangement of FIG. 13, in which each leg 1*a*' is extended laterally to have the form of an elongate beam, hereshown running for a substantial distance lengthwise of the joist J1. With such a beam-form leg 1*a*' there is less need for having a leg to support all four corners of a flooring panel. One such beam leg 1*a*' mounted on joist J1 and another on the adjacent joist J2 may in some cases suffice. This does, however, depend upon the length of the flooring panel lengthwise of the joists and the corresponding length of beam of the beam leg 1*a* as well as the strength of flooring panel and load to be supported.

The channel or tunnel void 8 between the legs, 1*a*, 1*b* is notably aligned with and contiguous with the void/channel between the joists J1, J2. As a result of this configuration the insulation material may first be laid between the joists J1, J2 to the required depth rising above the joists and the bridging support 1 then mounted in place accommodating the laid insulation I without compacting the insulation. There is no strict need for back-filling or cross-laying the upper layers of insulation, though for some modes of use this is still preferable, and no compaction. Furthermore, the system can be laid with less reliance on nailing components in place since each right-angled or saddle-shaped foot 3 substantially restricts movement of the bridging support 1 in the direction orthogonal to the joist 1*a*. This in itself can make the system much quicker to install than prior art systems, and also quicker to lift up or uninstall when needed.

As noted above, the bridging support 1 is suitably configured to be of a standard length of the order of 600 mm, 1200 mm and 1800 mm corresponding to the common 600 mm inter-joist span. Where the length is greater than approximately 600 mm an intermediate support leg may be used. The height of the bridging support 1 is selected to match the required extra height of the floor above the joists J1, J2 to allow the required depth of insulation to be un-compacted. Thus for the case where the joists are 80 mm deep and the required depth of insulation is 250 mm the height of the bridging support is the extra 170 mm or so. For this and other embodiments the required insulation depth is likely to be between 250 mm and 400 mm and thus the height of the bridging support above the joists would only rarely need to exceed 350 mm.

The loft insulation material used may be of any suitable type whether currently known and commonplace or yet to be brought to market including, for example, glass fibre, foil-backed felt, rock fibre or mineral fibre blanket insulation—all of which are available in roll-form. These rolls fit snugly between the joists and are the most common type of insulation, being generally sold in 75 mm and 100 mm thicknesses and 300 mm to 1200 mm width, with lengths that range from 5 m to 9.4 m. Loose materials such as cork granules, exfoliated vermiculite, mineral wool or cellulose fibre are other available forms that could be used but are potentially very untidy and much less desirable. The most suitable form of insulation is roll-form and dimensioned to fit snugly between the joists up to the required 250 mm or 300 mm depth.

Figure 3:
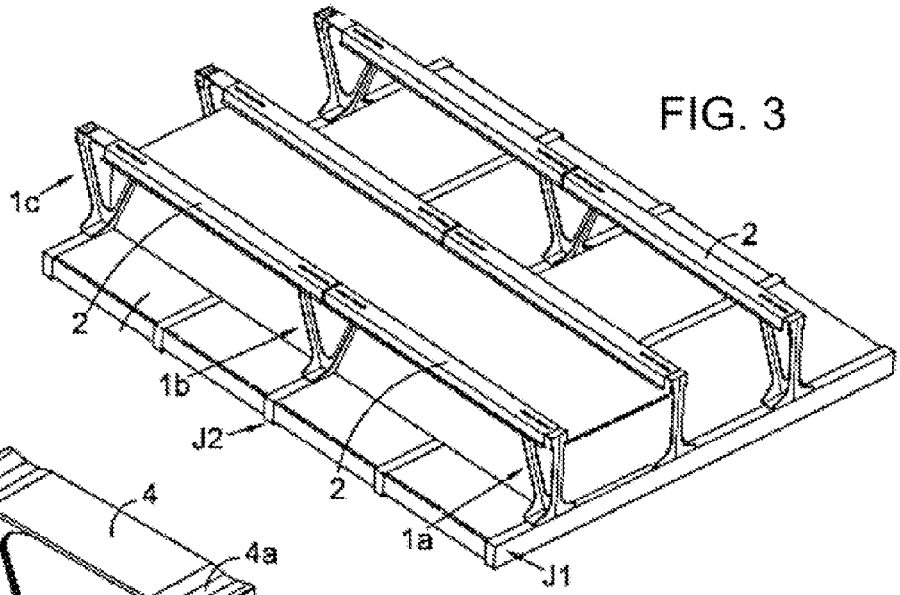
FIG. 3 is the first of a series of images of a preferred embodiment of the system, as installed, where each bridging support is formed of one upstanding support leg that is bifurcated and with a partial integral spanning portion at the top of the leg that links to the partial integral spanning portion of another upstanding leg by the intermediate separate spanning element/beam that is mounted thereon.

Turning to FIG. 3, this shows a preferred embodiment of the invention which, like the first embodiment, comprises a bridging support 1 in which the support 1 comprises a pair of legs 1*a*, 1*b* each with a foot 3 to mount to a respective joist J1, J2, with the tops of the legs 1*a*, 1*b* being linked in use by a separate spanning element/beam 2. However, here the individual legs 1*a*, 1*b* of the bridging support 1 are each of bifurcated form, splitting into two diverging stems/uprights 10 at or near the foot 3 of the leg 1*a*, 1*b*. The upper ends of the leg stems/uprights 10 each support a respective end of an elongate support platform 4 that extends in use orthogonal to the joist J1, J2 to which the foot 3 is mounted.

The spanning element 2 here is a rigid, strong beam of a metal or metal alloy such as steel or similar and has a channel-shaped profile which both strengthens the beam and facilitates its mounting atop the legs 1*a*, 1*b*. The channel 11 of the spanning element/beam 2 faces downwardly in use and its side walls 12 constrain the spanning element 2 in legs 1*a*, 1*b* against any movement in the direction along the joists J1, J2.

The strength of this channel-shaped spanning element/beam 2 is such that it may meet the floor strength criteria of being able to support approximately double the weight of a 90 kg individual standing upon it and yet is able to do so while having a span 1200 mm from a first joist J1 over an intermediate joist to a second joist J2 (that is not the next adjacent joist to the first joist J1) and without need of any support leg on the intermediate joist. Where each bridging support spans two adjacent parallel joists (1200 mm span) each bridging support is able to avoid intervening obstructions and as used as a primary/main component throughout the system it enables a substantially quicker and cheaper installation. For most applications the system supports loadings in excess of 1.4 $kNm^{-2}$.

Figure 5:
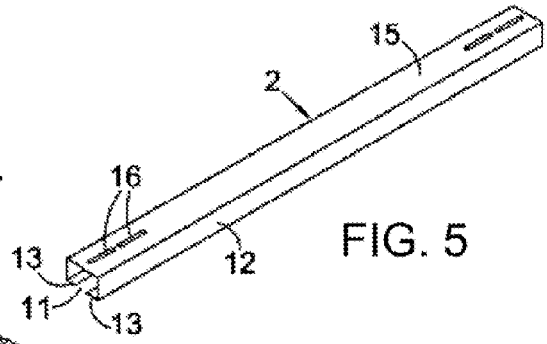
FIG. 5 shows the long intermediate separate spanning element and FIG. 6 shows a more compact variant of the support leg with the integral partial spanning portion extending in one direction only to suit use of the leg on a joist at a row end/proximate an edge of the loft.
Figure 7:
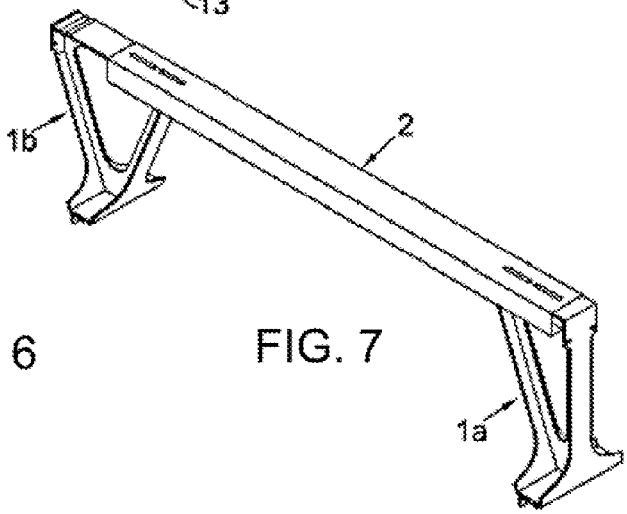
FIG. 7 illustrates a bridging support assembled from a leg of each of FIGS. 4 and 6 and the spanning element of FIG. 5.

The channel-shaped steel profile of the spanning element as shown in FIG. 3, has everted lateral rims/flanges 13 along the bottoms of the sidewalls 12, which is to say it has a flange 13 along each lower in use longitudinal edge that projects outwardly. These flanges 13 preferably are instead inverted/in-turned as shown in FIGS. 5 and 7, ie project inwardly to tuck under the spanning element 2 profile and with its ends thus tucking under the platform 4 on the legs 1*a*, 1*b*, there slotting into provided grooves 14 on the upper part of the legs 1*a*, 1*b* and thereby tying the spanning element 2 even more securely to the legs 1*a*, 1*b*.

At each end of the spanning element 2 there is a pair of elongate slot fixing apertures 16 in the top, in use, support wall 15 of the spanning element 2. These fixing apertures 16 allow a nail or other fixing to be driven therethrough into the underlying supporting leg top/platform 4 to fix the spanning element 2 in position. The slotted and plural nature of these fixing apertures 16 gives the installer a useful degree of flexibility in the positioning of the spanning element 2 end on the leg 1*a*, 1*b* in the direction orthogonal to the joist J1, J2 enabling the installer to adjust for variance in the inter-joist separation from the standard 600 mm et cetera, when nailing the spanning element 2 to the leg 1*a*, 1*b*. This positional adjustability is further enhanced by the configuration of the leg top/platform 4. This has an elongate form configured to extend in both directions orthogonal to the median/central vertical axis of the leg 1*a*, 1*b* and to the joist J1, J2 and including projecting out over the void between the joists J1, J2. The leg top/platform 4 serves as an integral spanning element portion that extends from an upper end of the uprights/stems 10 of the leg and projects towards the other leg in use and on which the spanning element/beam 2 is rested/supportively mounted. The integral spanning element portion/platform 4 projects over the channel between the joists J1, J2. It is notably orthogonal to the foot 3 on the leg 1*a*, 1*b*, since the foot 3 extends from the leg 1*a*, 1*b* in both axial directions along the corresponding joist J1, J2 to which it is mounted in use. This arrangement allows the leg to have an optimally compact yet optimally strong, stable form with the further desired characteristic of positioning adjustability for the spanning element 2.

The platform/top surface 4 of each leg 1*a*, 1*b* on which the spanning element 2 mounts is shown as having a dip/recess 4*a* into which the nail or other fixing to secure the element 2 to the leg may be driven so that the spanning element may be tightened down onto the platform, compressing into the dip/recess, giving greater hold onto the leg.

Strength of the legs 1*a*, 1*b* is aided not only by their bifurcated structure but also by their having a medial rib/flange 17 running therealong, on the underside thereof, whereby the leg 1*a*, 1*b* has an approximately T-shaped form, as viewed in transverse section (horizontal section of the uprights/stems 10). Indeed the medial rib/flange 17 suitably extends substantially the length of the uprights/stems 10 and the length of the platform 4 too.

Each leg 1*a*, 1*b* is suitably moulded entirely of a tough, strong, plastics material such as nylon. Thereby or otherwise it suitably has a foot that is partly or wholly of plastics whereby the foot counters cold-bridging. The foot 3 might be demountable but preferably, as illustrated, is integral to the leg 1*a*, 1*b*.

Figure 9:
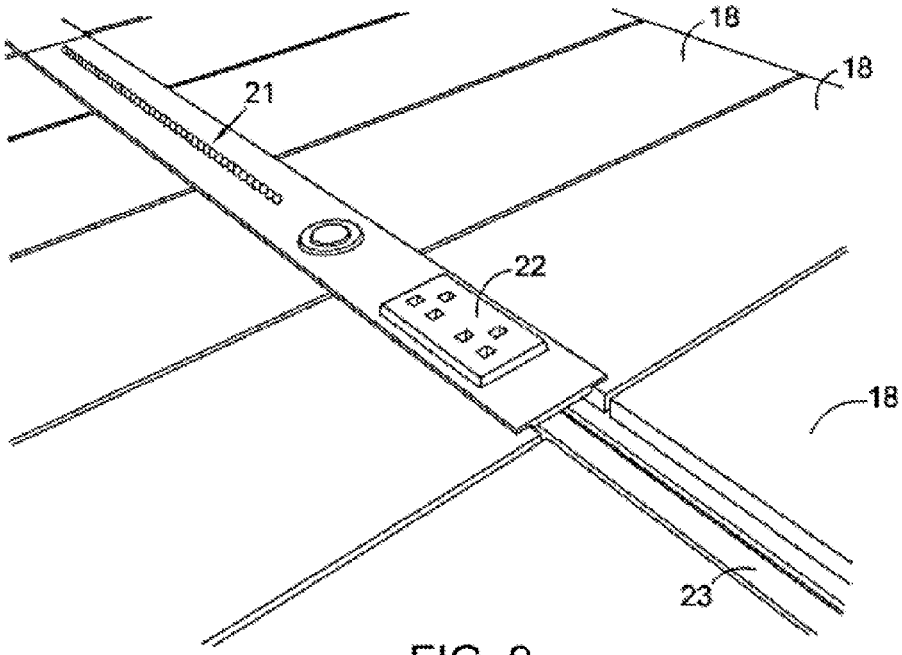
FIG. 9 shows provision of a fascia to the spanning element that incorporates strip lighting and a power point.

From FIG. 3 it will be seen that the flooring system is installed as a plurality of rows each traversing the joists J1,J2, the rows being parallel to each other but the rows not being inter-connected other than ultimately by the overlying floor panels/boards—ie having no supportive spanning element or other structural member below the floor panels/boards linking from one row to the next. (The floor panels/boards 18 that mount on top of the spanning elements/support beams 2 spanning over them are not shown in FIG. 3 but are shown in FIG. 9 onwards). The structure/configuration of the legs 1*a*, 1*b* provides them with sufficient strength and stability that the system does not need structural members spanning between the rows of beams 2 at the beams or at the legs.

In the example installation of FIG. 3 three rows of bridging supports 1 are shown, each row having a first bridging support 1 comprising two support legs 1*a*, 1*b* joined together by a spanning element beam 2 and the second support leg 1*b* extending to form a second bridging support 1 by being joined to a third leg, here shown as an end support leg 1*c*. For the average loft there will be of the order of a dozen or more joists and, of course, the process of assembly and installation of the bridging supports making up the row traversing all of the joists will follow this simple assembly pattern but be repeated as necessary. Similarly the process is repeated for each successive row to build up the whole floor. The steps for assembly are quick to execute and the array of parallel rows covering the loft floor area can be completed in little time and at modest cost. The process is further simplified by using a fitting/alignment tool as will be described later with respect to FIGS. 20 to 27.

Figure 6:
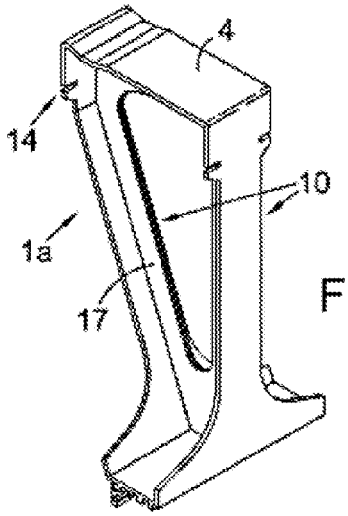

Turning for now to FIG. 6, this shows a compact version of support leg suitable for use as a first support leg 1*a* and last support leg 1*c* to form the ends of a row, and especially where space is restricted. Indeed this is the form of leg used as the first leg 1*a* and last leg 1*c* in FIG. 3. This notably has the platform 4 extending in one direction only from the vertical axis of the leg, namely in the direction of the adjacent joist.

Figure 4:
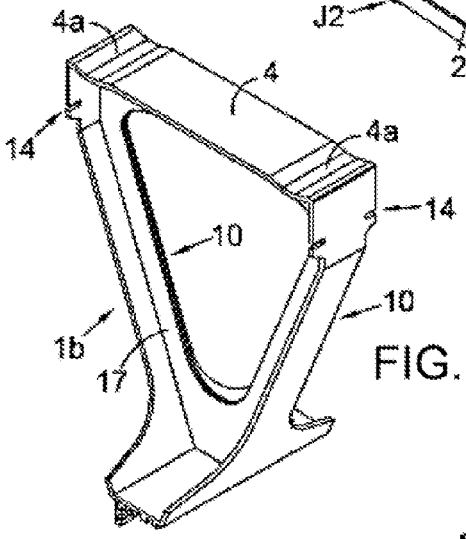

The main version of leg as shown in FIG. 4, for use on the joists other than the loft edge first and last joists, suitably has the platform 4 extending substantially symmetrically fore and aft of the vertical axis of the leg in the direction spanning the joists, thus allowing for positioning adjustment of the spanning element/beam 2 that mounts to it both from a preceding position along the row and the spanning element/beam 2 from a successive position along the row.

As with the installation of FIGS. 1 and 2, in this embodiment the insulating material I can be first laid between the joists preferably such as to rise to a level above the top of the joists and then further insulating material may be laid orthogonal/transverse to the joists between the bridging supports 1 to cover the joists and to transversely cover the initially laid lengths of insulating material. The flooring panels/boards 18 may then be laid in place on top of the rows of spanning elements/beams 2.

In a variant of the construction of the spanning element 2, instead of being of steel only construction it may be formed as a composite of a steel skeleton with a plastics moulded case or upper panel that suitably clips, slides or otherwise fastens onto the steel skeleton to provide a medium into which fixings such as screws or nails may be driven to secure the overlying boards/panels of the flooring. Forming the spanning element with a sturdy skeleton manufactured from pressed steel (suitably in one piece) reduces cost to manufacture and because the steel is not the fixing medium it can be thicker and stronger than when the steel of the spanning element is the fixing medium.

Figure 8:
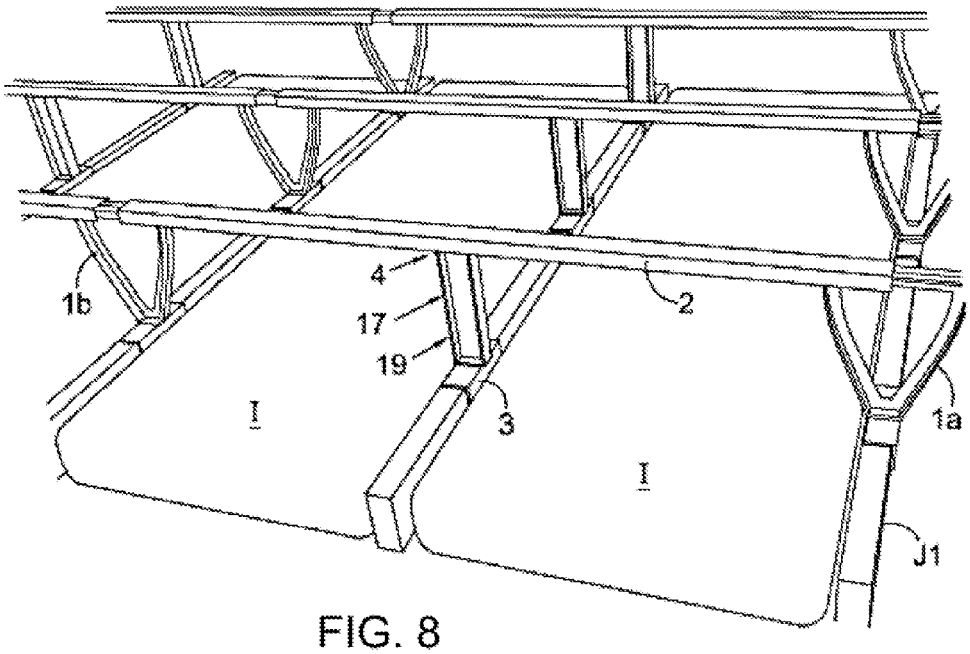
FIG. 8 shows provision of an extra support pillar/leg for intermediate support to the long spanning element of the preferred embodiment when the spanning element spans three or more joists (two or more inter-joist channels).

Turning now to FIG. 8, this shows use of an optional extra support pillar/leg 19 for intermediate support to the long spanning element 2 of the preferred embodiment when the spanning element 2 is used to span three or more joists two or more inter-joist channels—eg the spanning element/beam 2 being 1200 or 1800 mm long where the joists are 600 mm apart). This can be particularly useful for the triple span (eg 1800 mm) spanning element 2. This extra support leg 19 is not bifurcated but rather is a simple upright pedestal with a single stem. Otherwise, this extra support leg 19 as illustrated is similar to the legs 1*a*, 1*b* in having a median rib/flange 17, a foot 4 that has a right-angled bracket form that extends in both directions along the joist and a upper platform 4 at the upper end of the leg 19.

Turning to FIG. 9, this shows a fascia 20 that may be mounted to the spanning element/beam 2 and which incorporates strip lighting 21 (comprised here suitably of a row of LEDs) and an electrical power outlet double socket 22. This fascia 20 is suitably fitted as a cap to an upper channel/track 23 that is assembled to or integral with the upper, in use, side of the spanning element/beam 2 and which is shown in more detail in FIGS. 10 to 13. The design of the fascia may be adjusted to lie substantially flush with the flooring.

Figure 10:
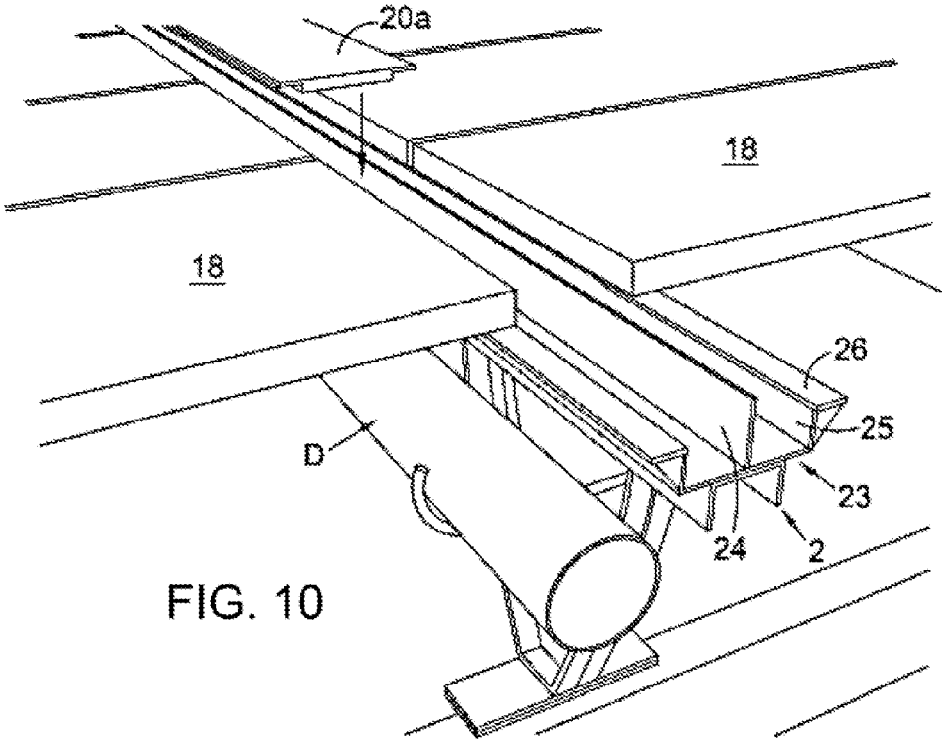
FIG. 10 is the first of a series of views showing use of a modified version of the system in which the spanning element is adapted to incorporate services such as electrical cabling or pipe-work therein or thereunder—here the spanning element has an integrally formed or assembled track at its top side, which carries electrical cabling or small bore pipes in channels while the support legs have support brackets or hooks to support larger bore pipe-work (eg for heat recovery ducting) extending below the spanning elements.
Figure 11:
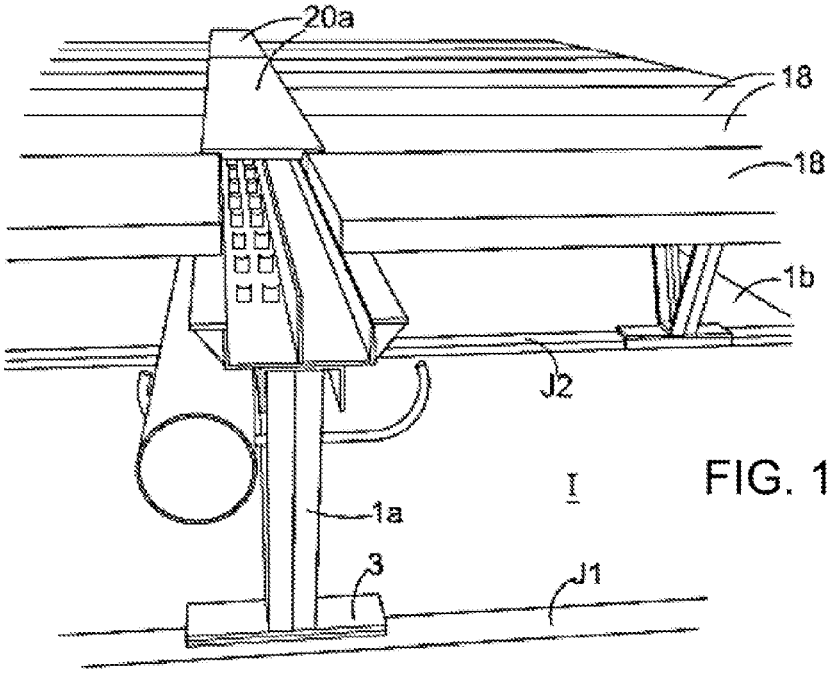
Figure 12:
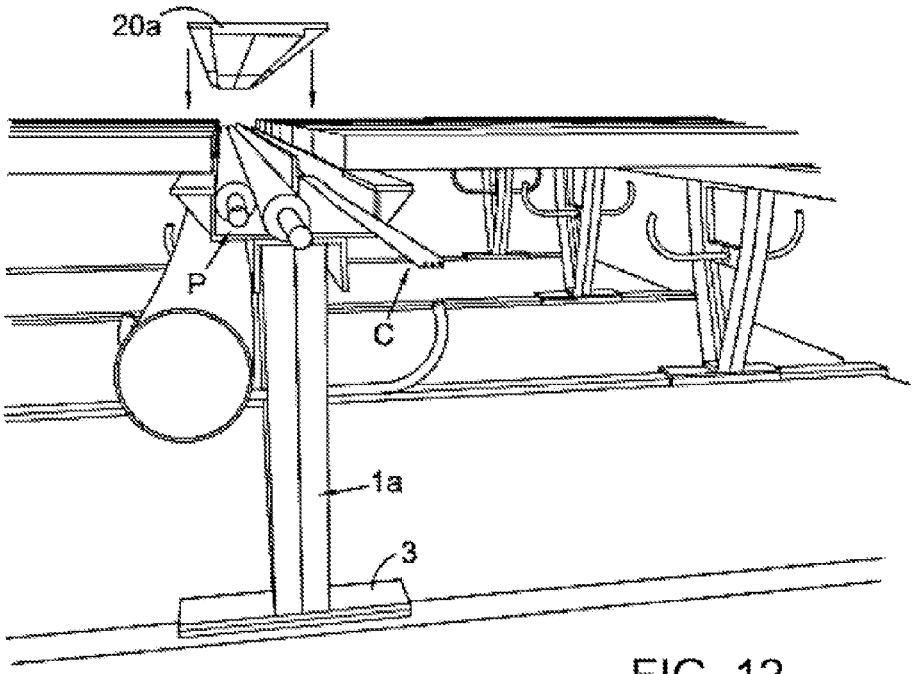
FIG. 12 shows power and data cables installed in the track.

FIG. 10 shows the modified version of the spanning element/beam 2 which incorporates services such as electrical cabling C and small bore pipes (eg insulated copper pipes for water) P in the spanning element 2. These are carried in an integrally formed or assembled upper channel/track 23 at the top side of the spanning element 2. As illustrated (see FIG. 12), the upper channel/track 23 is divided centrally by a partition wall 24 to receive the cables C running along the channel on one side of the wall 24 and receive the pipes P running along the channel on the other side of the wall 24. The outer sidewalls 25 of the upper channel/track 23 each have an out-turned perimeter flange 26 at their upper end to provide the support shelf on which the flooring panels/boards 18 are mounted. Where the special strip lighting and/or power outlet fascia 20 is not required the channel 23 is covered with a simpler blank cap/cover 20*a* which suitably again is of steel and which is easily removable for maintenance.

Figure 14:
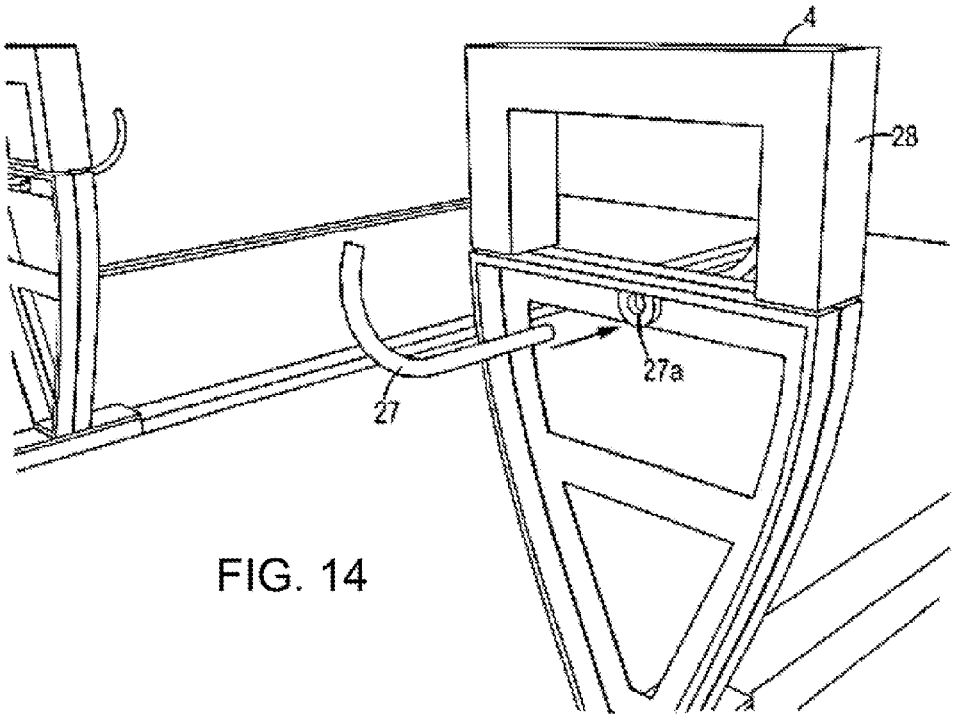

For larger bore pipe-work D and especially, for example, for heat recovery ducting, the support legs 1*a*, 1*b* are modified to have support brackets or hooks 27 to support the pipe-work D extending along below the row of spanning elements 2. Referring to FIG. 13, a leg upward extension member such as the illustrated arched leg extension 28 may be mounted to the top of each leg 1*a*, 1*b* to raise the level of the platform 4 on which the spanning element 2 rests higher and thus raise the cable-carrying spanning element 2 higher above the insulation I to allow room for the larger bore pipe-work/ducting D above the insulation I. The support brackets hooks 27 for the under-hung pipe-work D are suitably demountably fitted to the legs 1*a*, 1*b* by a press fit or screw fit mounting into a socket 27*a* in the leg 1*a*, 1*b* as shown in FIG. 14.

Figure 15:
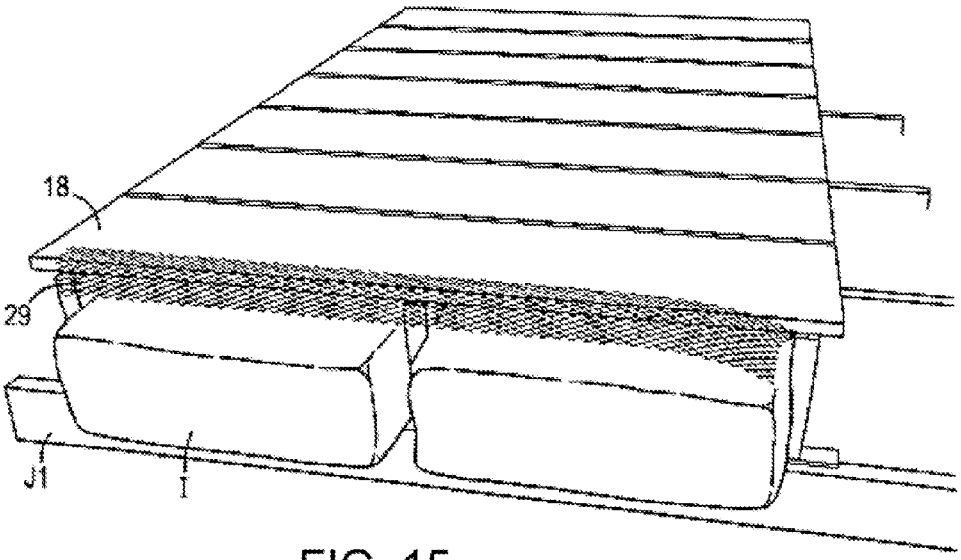
FIG. 15 shows use of breathable sealing tape to reduce draughts at gaps between the perimeter of the system and the joists.

Turning to FIG. 15, this shows provision of a breathable sealing tape 29 applied to cover over the gap between the perimeter of the flooring system and the joist J1 from the level of the edge floor panel 18 at least down to the insulation I to reduce any draughts therebetween. Such tape may be a perforated adhesive tape for breathability and it allows only a controlled slow movement of air through it to prevent moisture build-up.

Figure 16:
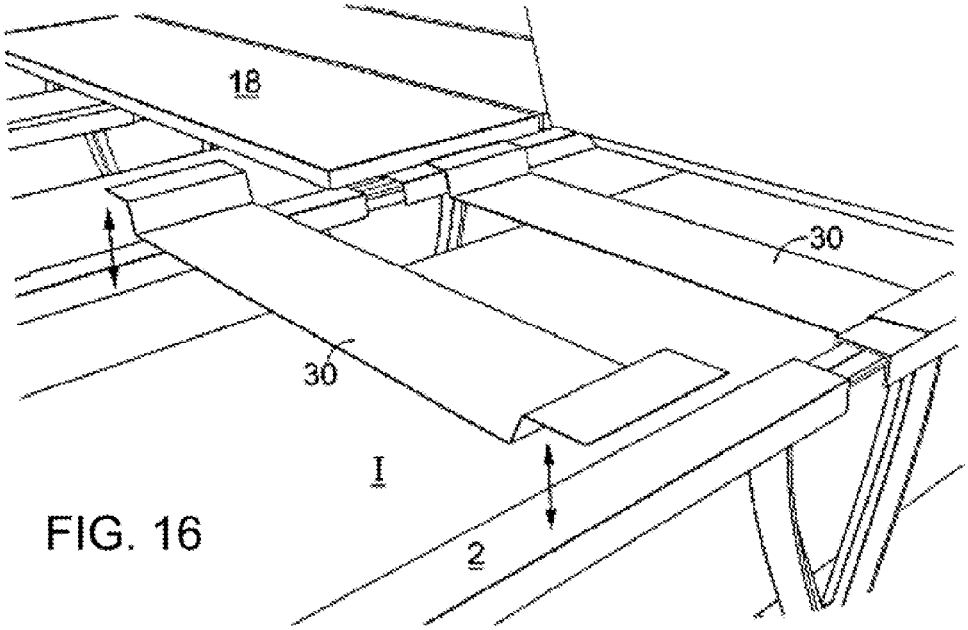
FIG. 16 is the first of a series of images that show provision of a set of rigid edge-support shelves in a row that are hung spanning between two adjacent rows of the fitted spanning elements, extending parallel to the joists and configured to support the edges of storage containers, while FIG. 17 and FIG. 18 respectively show a storage container being pushed across the flooring into place in the shelving row and then laterally adjusted along the shelving row for the container to align between edge support shelves.
Figure 17:
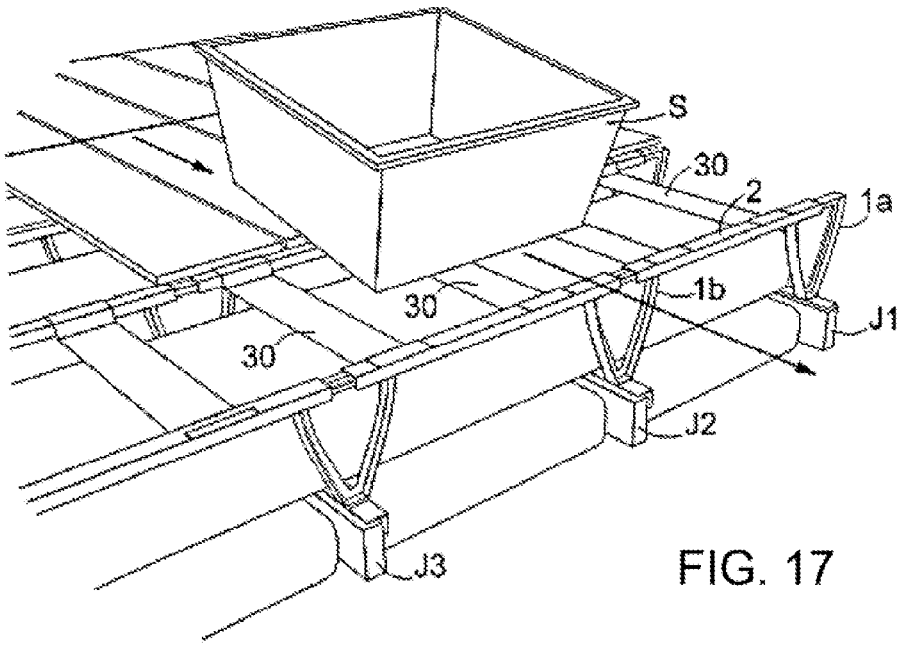
Figure 18:
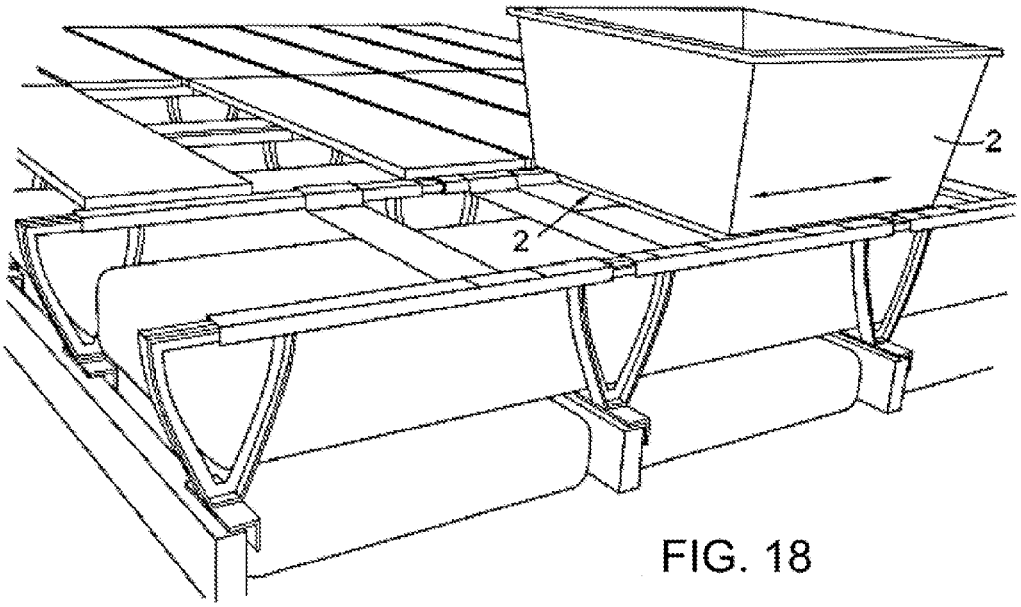
Figure 19:
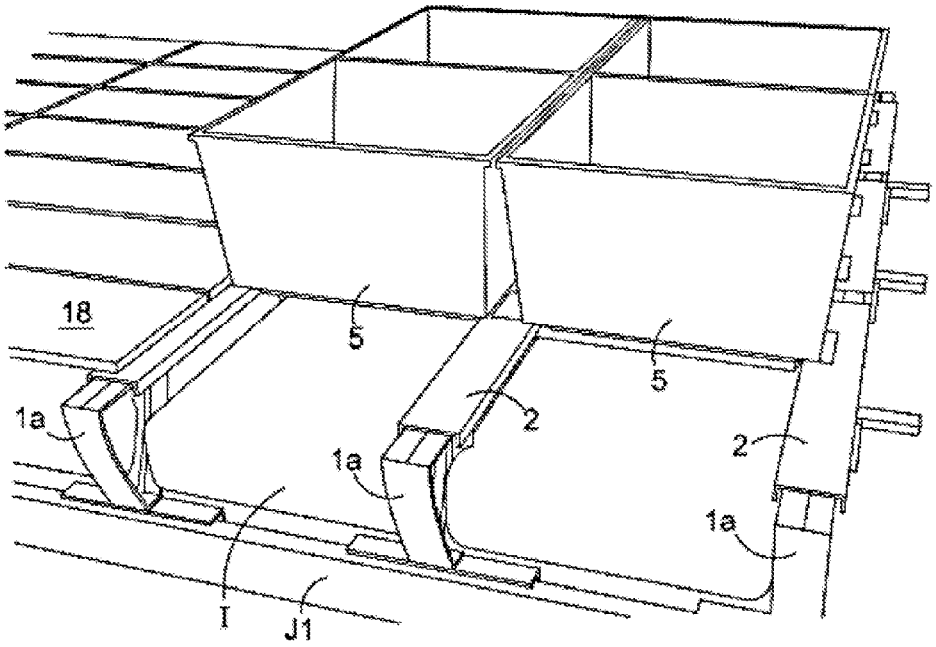
FIG. 19 shows a pair of shelving rows supporting a plurality of storage containers.

Turning to FIG. 16, the flooring system may be adapted for part to be used specifically for accommodating inter-row fitting storage containers that take advantage of the space between rows of fitted spanning elements 2 to provide a parking zone for the containers that holds them neatly in place. Here a set of rigid edge-support shelves 30 is arranged in a transverse row that are hung spanning between two adjacent rows of the fitted spanning elements 2, extending parallel to the joists J1, J2 and configured to support and constrain in place the rebated bottom edges R (see FIG. 18) of the storage containers S. The spacing between edge-support shelves 30 defines a receptacle into which the bottom of each storage containers S drops to be held against further horizontal movement. The system thus regularizes the positioning of the storage containers for efficient storage, but each can be removed or replaced simply by lifting slightly to disengage the rebated bottom edges R of the container S from the edge-support shelves 30.

Figure 20:
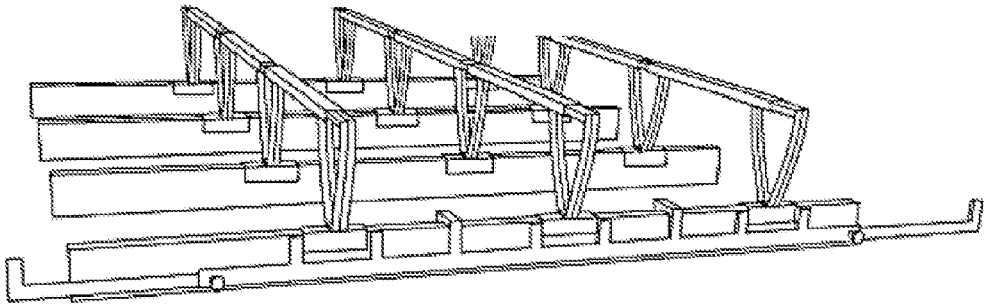
FIG. 20 is the first of a series of images that show use of an elongate fitting tool for rapid uniform installation of multiple rows of the flooring system.
Figure 21:
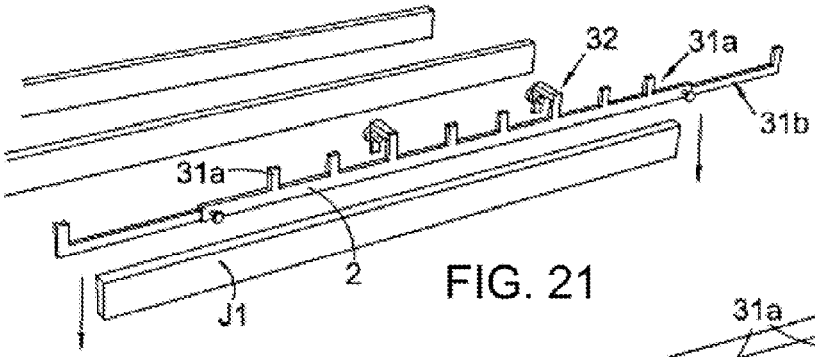
Figure 22:
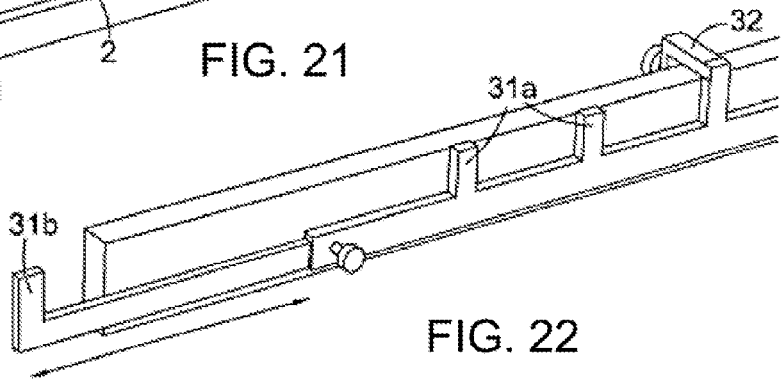
FIG. 22 indicates adjustment of end extensions of the tool to select a set spacing of the first row of legs from the loft perimeter.
Figure 23:
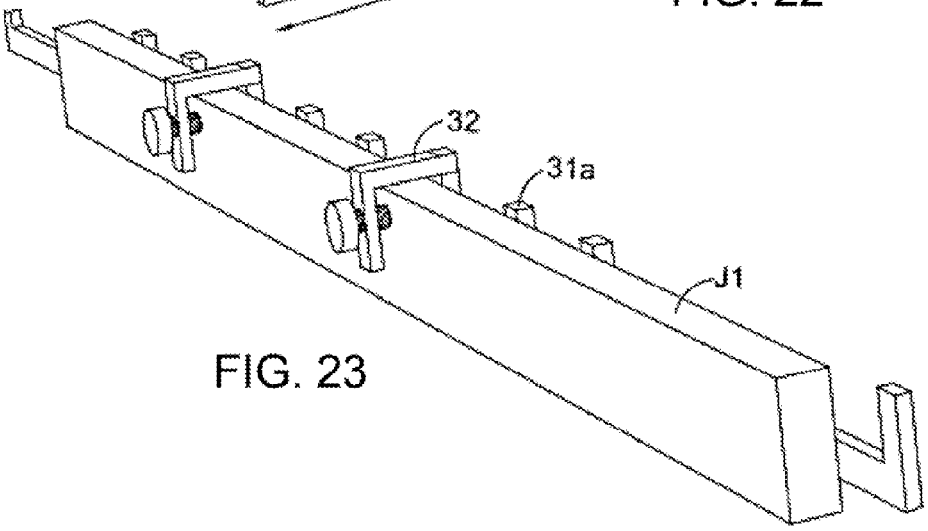
FIG. 23 shows detail of an integral pair of clamps for securing the tool to the joist while it is being used.
Figure 24:
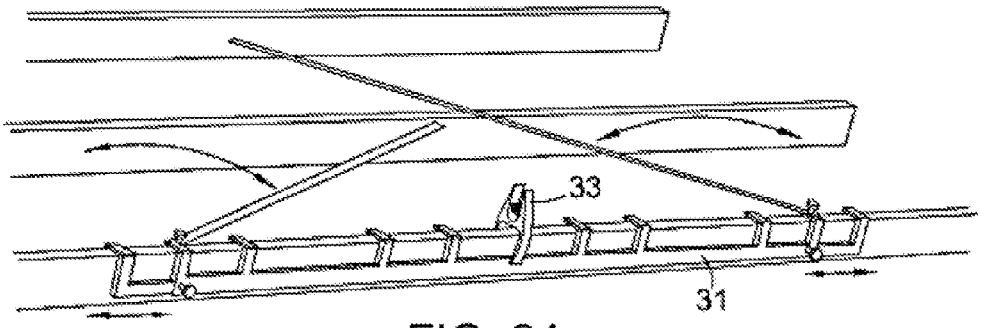
FIG. 24 is the first of a series of images of a variant of the elongate fitting tool that has a crocodile clip type sprung clamp and has a pair of pivoting alignment bars for rotating to extend orthogonal to the joist to align the legs on the second joist with those on the first.

Turning to FIG. 20, this shows use of an elongate fitting tool 31 for rapid uniform installation of multiple rows of the flooring system. The tool has spaced apart fingers 31*a* along its length at intervals that define the spacing of the feet 3 of the rows along each joist. FIG. 21 shows the tool being lowered to mount to a first joist, while FIG. 22 indicates adjustment of end extensions 31*b* of the tool 31 to select a set spacing of the first row of legs from the loft perimeter, and FIG. 23 shows detail of an integral pair of clamps 32 for securing the tool 31 to the joist J1, J2 while it is being used.

Figure 25:
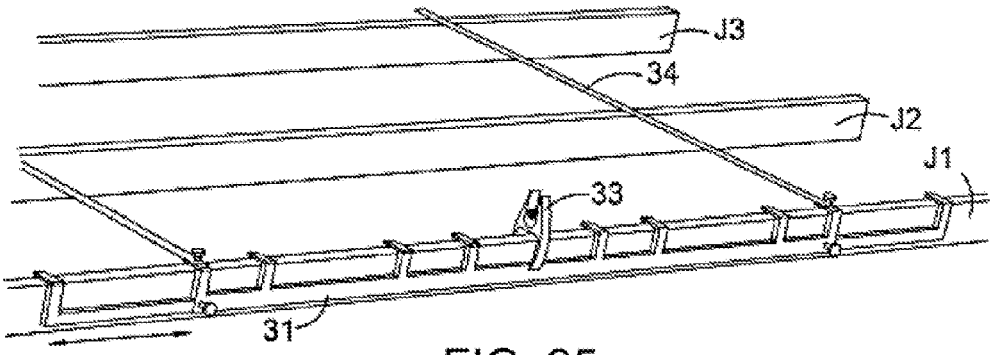
FIG. 25 shows the alignment bars in their operative state.
Figure 26:
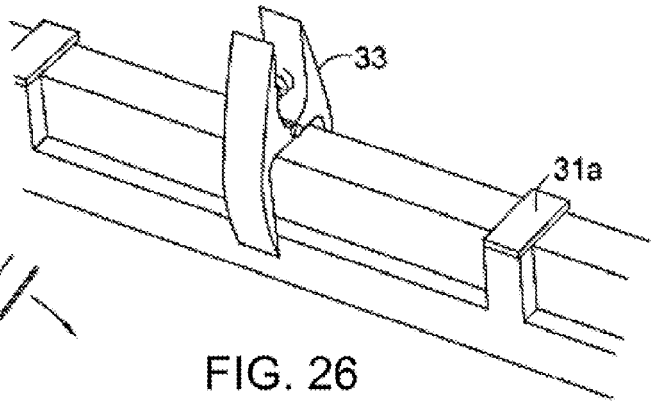
FIG. 26 shows the clamp in detail and FIG. 27 shows the pivot mounting of one of the alignment bars in detail.
Figure 27:
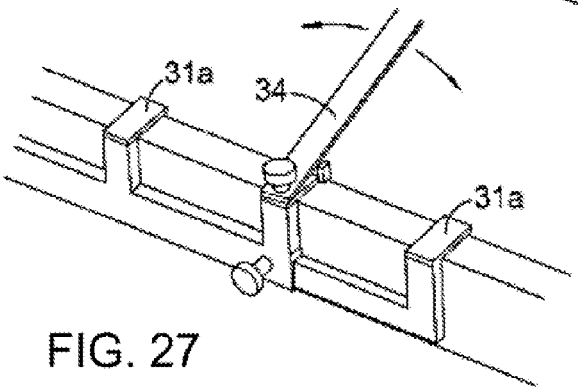
Figure 28:
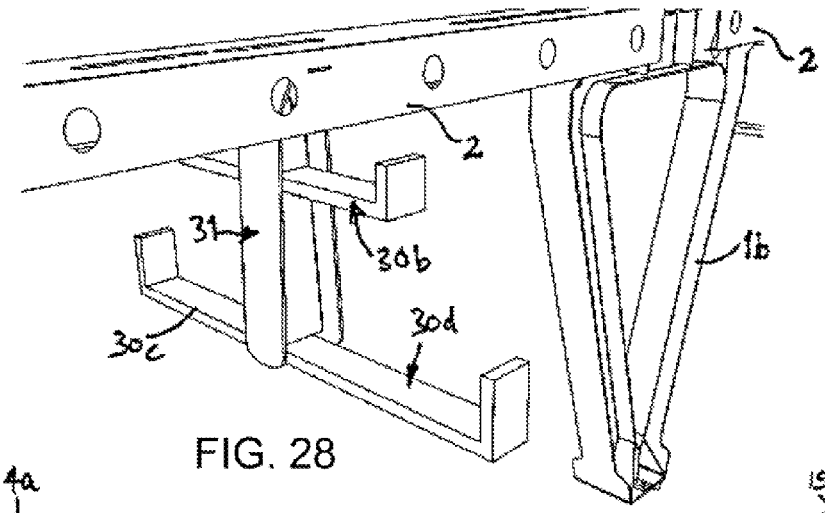
FIG. 28 is a perspective view of a services conduit support system aspect of the invention as shows a preferred embodiment of that spect of the invention adapted for use in a loft raised flooring system.

In FIGS. 24 to 27 a variant of the elongate fitting tool 31 is shown that has a crocodile clip type sprung damp 33 and has a pair of pivoting alignment bars 34 for rotating to extend orthogonal to the joist to align the legs on the second joist J2 with those on the first joist J1. FIG. 25 shows the alignment bars in their operative state. FIG. 26 shows the clamp in detail and FIG. 27 shows the pivot mounting of one of the alignment bars in detail. This variant of the tool 31 mounts nearer the top of the joist J1, J2 on the side. Again the spacer fingers 31*a* fit over the top of the joist J1 in a right angle bracket configuration (like the foot 3). This arrangement is superior to the preceding embodiment since it will not interfere with the insulation I already installed between the joists J1, J2 when the legs 1*a*, 1*b* are installed.

As a further innovation, when installing down-lighters in the loft floor amongst the insulation, since the 300 mm or so high depths of insulation are achieved, the system may further provide an extra tall heat shielding tube or casing, of the order of from 350 mm tall to 400 mm tall or greater, that may be used instead of, or in addition to and externally over, existing heat shielding provided with or for the down-lighters.

Figure 34:
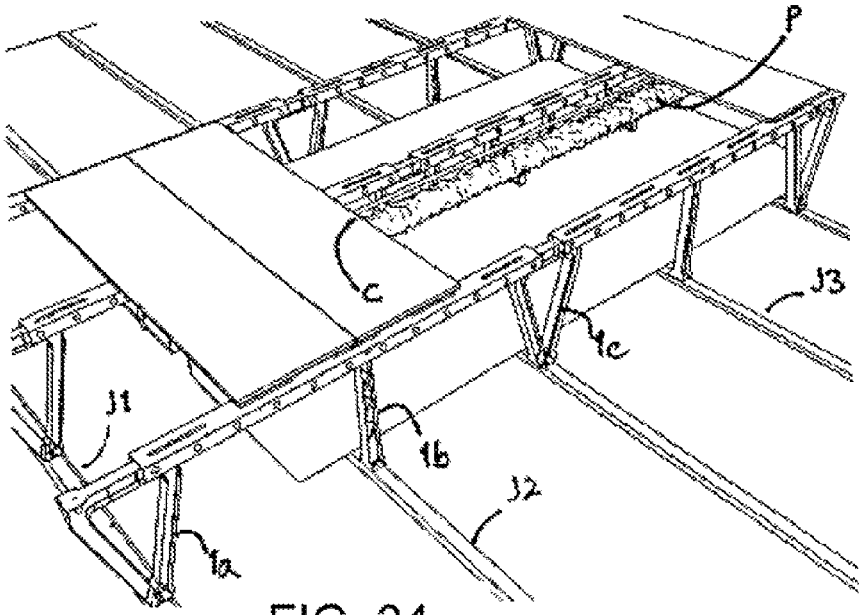

In the illustrated embodiment of FIGS. 28 to 34 the raised loft flooring system is optimised for installing/supporting services conduits such as electrical cables and pipes. The raised loft flooring system is substantially as in the preceding embodiments and comprises a plurality of rows of bridging supports 1 as shown in FIG. 34. Each bridging support 1 bridges between the joists J1, J2 of a floor. Each bridging support 1 comprises a pair of legs 1*a*, 1*b* each with a foot 3 to mount to a respective joist J1, J2, with the tops of the legs 1*a*, 1*b* being linked in use by a separate spanning element/beam 2.

Figure 31:
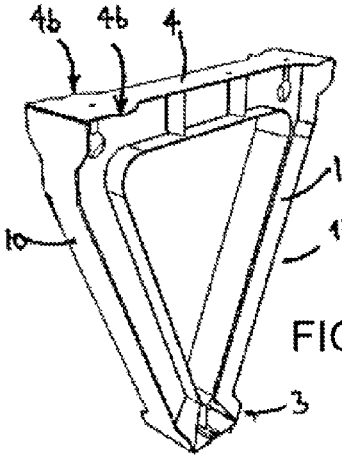
Figure 32:
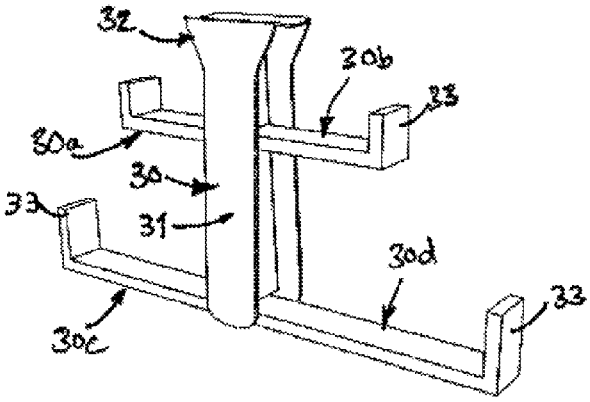
FIG. 32 is a detailed view of a position adjustable services conduit support hanger of the system.
Figure 33:
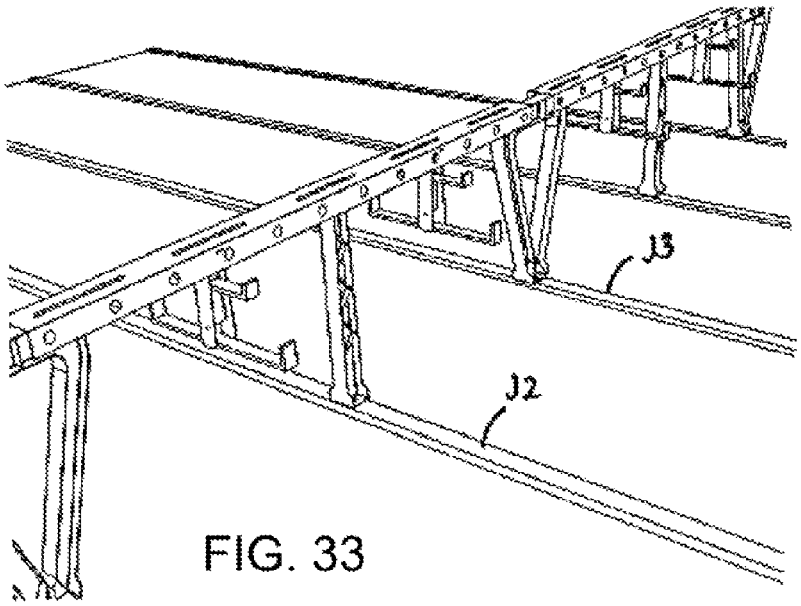
FIG. 33 is a further perspective view of the FIG. 28 system during assembly as implemented in a loft raised flooring system with the legs standing on joists of the loft and FIG. 34 shows some of the floor panels in place on the legs and a cable and insulated pipe being carried by support hangers on a middle one of the three illustrated rows of legs.

The majority of the individual legs 1*a*, 1*b* of the bridging support 1 are, as shown in FIG. 31, of bifurcated form, splitting into two diverging stems/uprights 10 at or near the foot 3 of the leg 1*a*, 1*b* and that are relatively wide apart at the top. The upper ends of the leg stems/limbs 10 each support a respective end of an elongate support platform 4 that spans between the limbs 10 and extends in use orthogonal to the joist J1, J2 to which the foot 3 is mounted.

Figure 30:
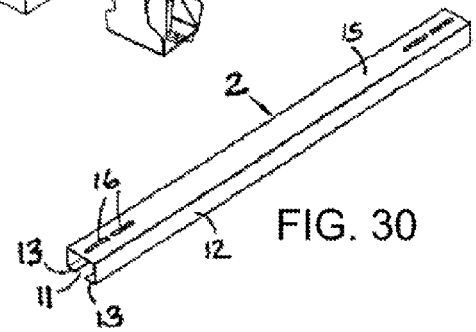
FIG. 30 shows the spanning beam in detail and FIG. 31 shows one of the legs in detail.

Referring to FIG. 30, the beam/spanning element 2 suitably is a rigid, strong beam of a metal or metal alloy such as steel or similar and has a channel-shaped profile which both strengthens the beam and facilitates its mounting atop the legs 1*a*, 1*b*. The channel 11 of the spanning element/beam 2 faces downwardly in use and its side walls 12 constrain the spanning element 2 in place on the legs 1*a*, 1*b* against any movement in the direction along the joists J1, J2. The strength of this channel-shaped spanning element/beam 2 is such that it may meet the floor strength criteria of being able to support approximately double the weight of a 90 kg individual standing upon it and yet is able to do so while having a span 1200 mm from a first joist J1 over an intermediate joist to a second joist J2 (that is not the next adjacent joist to the first joist J1) and without need of any support leg on the intermediate joist. Where each bridging support spans two adjacent parallel joists (1200 mm span) each bridging support is able to avoid intervening obstructions and as used as a primary/main component throughout the system it enables a substantially quicker and cheaper installation. For most applications the system supports loadings in excess of 1.4 $kNm^{-2}$.

The channel-shaped steel profile of the spanning element/beam 2, as shown in FIG. 30, has inverted lateral rims/flanges 13 along the bottoms of the sidewalls 12, which is to it has a flange 13 along each lower in use longitudinal edge that projects inwardly to tuck under the spanning element 2 profile and with its ends thus tucking under the platform 4 on the legs 1*a*, 1*b*, there slotting into provided grooves 14 or over lateral projecting tabs 4*b* on the upper part of the legs 1*a*, 1*b* and thereby tying the spanning element 2 even more securely to the legs 1*a*, 1*b*.

At each end of the spanning element 2 there is a pair of elongate slot fixing apertures 16 in the top, in use, support wall 15 of the spanning element 2. These fixing apertures 16 allow a screw or other fixing to be driven therethrough into the underlying supporting leg top/platform 4 to fix the spanning element 2 in position. The slotted and plural nature of these fixing apertures 16 gives the installer a useful degree of flexibility in the positioning of the spanning element 2 end on the leg 1*a*, 1*b* in the direction orthogonal to the joist J1, J2 enabling the installer to adjust for variance in the inter-joist separation from the standard 600 mm et cetera, when nailing the spanning element 2 to the leg 1*a*, 1*b*. This positional adjustability is further enhanced by the configuration of the leg top/platform 4. This has an elongate form configured to extend in both directions orthogonal to the median/central vertical axis of the leg 1*a*, 1*b* and to the joist J1, J2 and including projecting out over the void between the joists J1, J2.

The leg top/platform 4 serves as an integral spanning element portion that extends from an upper end of the uprights/stems 10 of the leg and projects towards the other leg in use and on which the spanning element/beam 2 is rested/supportively mounted. The integral spanning element portion/platform 4 projects over the channel between the joists J1, J2. It is notably orthogonal to the foot 3 on the leg 1*a*, 1*b*, since the foot 3 extends from the leg 1*a*, 1*b* in both axial directions along the corresponding joist J1, J2 to which it is mounted in use. This arrangement allows the leg to have an optimally compact yet optimally strong, stable form with the further desired characteristic of positioning adjustability for the spanning element 2.

Figure 29:
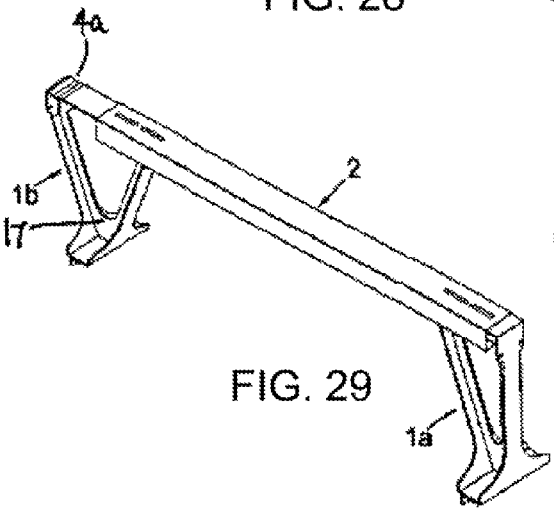

The platform/top surface 4 of each leg 1*a*, 1*b* on which the spanning element 2 mounts is shown in FIG. 29 as having a dip/recess 4*a* into which the nail or other fixing to secure the element 2 to the leg may be driven so that the spanning element may be tightened down onto the platform, compressing into the dip/recess, giving greater hold onto the leg. Strength of the legs 1*a*, 1*b* is aided not only by their bifurcated structure but also by their having a medial rib/flange 17 running therealong, on the underside thereof, whereby the leg 1*a*, 1*b* has an approximately T-shaped form, as viewed in transverse section (horizontal section of the uprights/stems 10). Indeed the medial rib/flange 17 suitably extends substantially the length of the leg uprights/stems 10 and the length of the platform 4 too. Each leg 1*a*, 1*b* is suitably moulded entirely of a tough, strong, plastics material such as nylon. Thereby or otherwise it suitably has a foot that is partly or wholly of plastic's whereby the foot counters cold-bridging. The foot 3 might be demountable but preferably, as illustrated, is integral to the leg 1*a*, 1*b*.

From FIG. 34 it will be seen that the flooring system is installed as a plurality of rows each traversing the joists J1,J2, the rows being parallel to each other but the rows not being inter-connected other than ultimately by the overlying floor panels/boards—ie having no supportive spanning element or other structural member below the floor panels/boards linking from one row to the next. (The floor panels/boards 18 that mount on top of the spanning elements/support beams 2 spanning over them are not shown in FIG. 33 but are shown in FIG. 34). The structure/configuration of the legs 1*a*, 1*b* provides them with sufficient strength and stability that the system does not need structural members spanning between the rows of beams 2 at the beams or at the legs. In the example installation of FIG. 34 three rows of bridging supports 1 are shown, each row having a first bridging support 1 comprising two support legs 1*a*, 1*b* joined together by a spanning element/beam 2 and the second support leg 1*b* extending to form a second bridging support 1 by being joined to a third leg 1*c* and so forth. For the average loft there will be of the order of a dozen or more joists and, of course, the process of assembly and installation of the bridging supports making up the row traversing all of the joists will follow this simple assembly pattern but be repeated as necessary. Similarly the process is repeated for each successive row to build up the whole floor. The steps for assembly are quick to execute and the array of parallel rows covering the loft floor area can be completed in little time and at modest cost.

To carry the cabling and pipe-work in the embodiment of FIGS. 28 to 34 each beam 2 can co-operatively engage with a respective one of a set of services conduit support hangers 30 that are adapted to hang from the beam 2. The support hangers 30 as seen in FIGS. 28, 32, 33 and 34 is have support arms 30*a-d* to carry the cables or pipe-work.

Each support hanger 30 of this embodiment has a stem 31 that extends vertically down from the beam 2 in use and with an enlarged head part 32 at the top of the stem 30 that couples with the beam 2 by the head 32 sitting in the channel of the beam 2 and the narrower stem 30 extending down through the gap between the flanges 13 that project from the channel's sidewalls. The support hanger is thus adapted to slidingly engage within the channel of the beam 2 to hang from the beam 2 and be slidable along the channel to be positionally adjustable along the length of the beam 2. The stem 31 has four support arms 30*a-d* projecting laterally outwardly to provide horizontal support shelves in use. Each arm 30*a-d* is substantially straight and with an upturn/lip 33 at the end to lateraily retain the insulated pipe-work P or electrical cabling C in place (FIG. 34).

The hanger 30 illustrated has two pairs of support arms 30*a,b* and 30*c,d*. Each pair is arranged at a respective level along the length of the stem 31 with one arm 30*a* of the pair extending perpendicularly from one side of the stem 31 and the other arm of the pair extending perpendicularly from the other side of stem 31.

The first pair of support arms 30*a*, 30*b* are at a first, upper in use, level along the stem 31 and the second pair of support arms are at a second level lower down the length of the stem. The second/lower pair of arms 30*c*, 30*d* is longer than upper pair of arms 30*a*, 30*b* . Having the arms at different levels provides multi-tier support whereby the upper tier 30*a*, 30*b* can carry smaller service conduit such as electrical cable C or small bore piping while the lower carries thicker bore/insulated pipe P.

Figure 35:
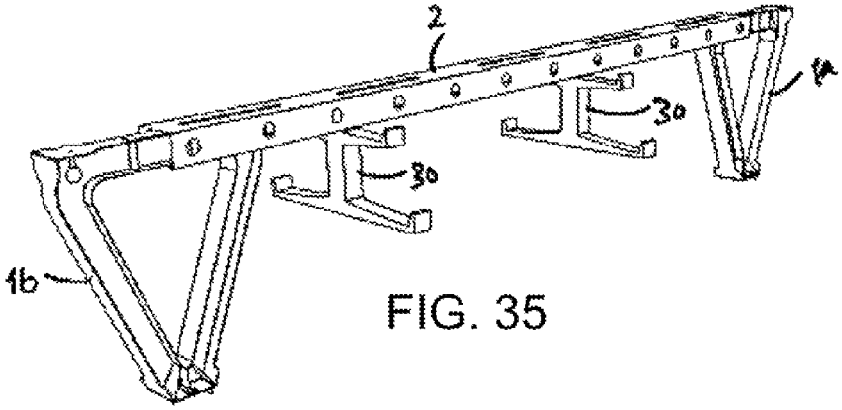
Figure 36:
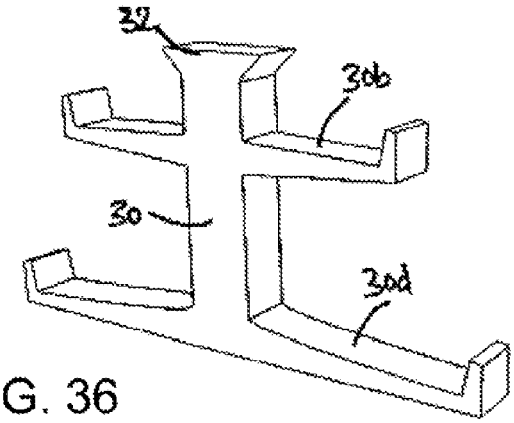
Figure 37:
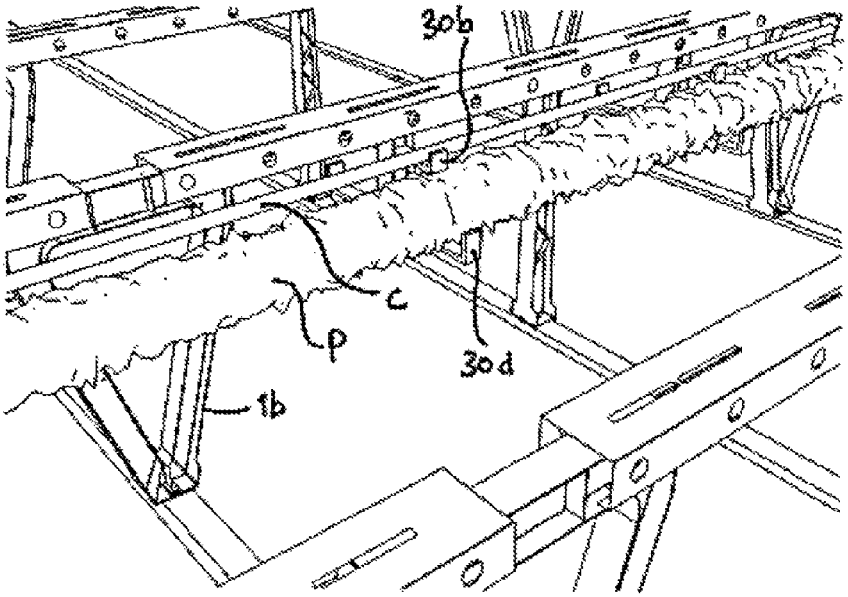
FIG. 37 shows that hanger in use in a loft raised floor system, carrying a cable on the upper tier and a pipe on the lower tier

Turning to FIGS. 35 to 37, the support hanger 30 here is essentially the same as in FIG. 28-34 but formed as a one piece moulding or casting, rather than assembled from several components such as pressed steel plates and extruded bars.

Figure 38:
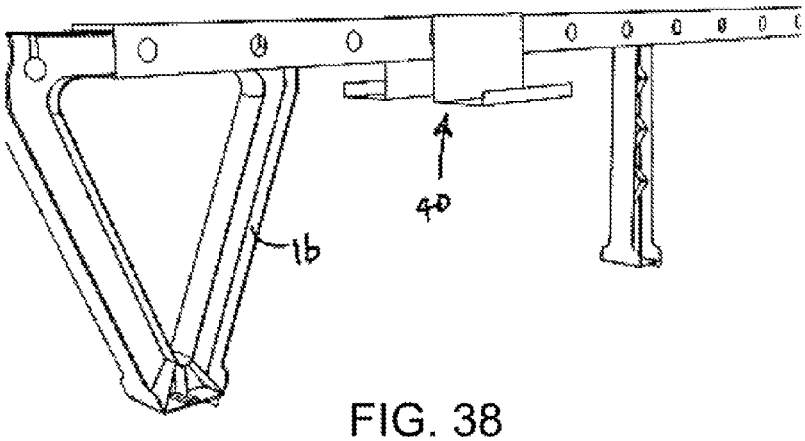
FIG. 38 is a perspective view of a second embodiment of the services conduit support system, having a third form of position adjustable services conduit support hanger
Figure 39:
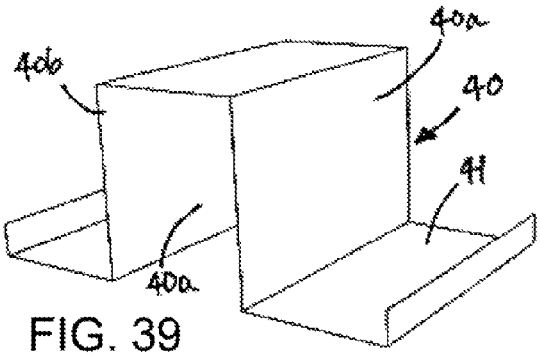
FIG. 39 is a detailed view of that third form of support hanger.
Figure 40:
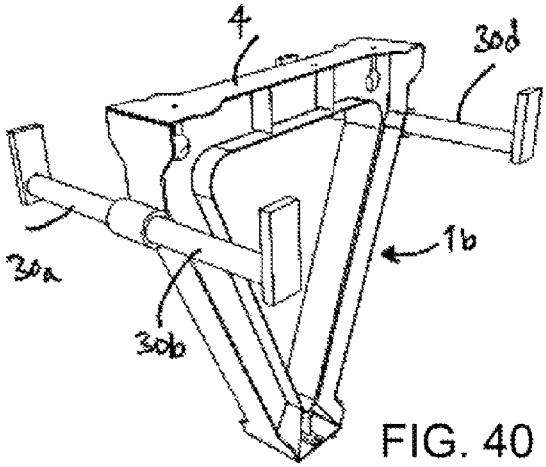
FIG. 40 is a detailed view of a services conduit support that is integral to the raised floor support leg.
Figure 41:
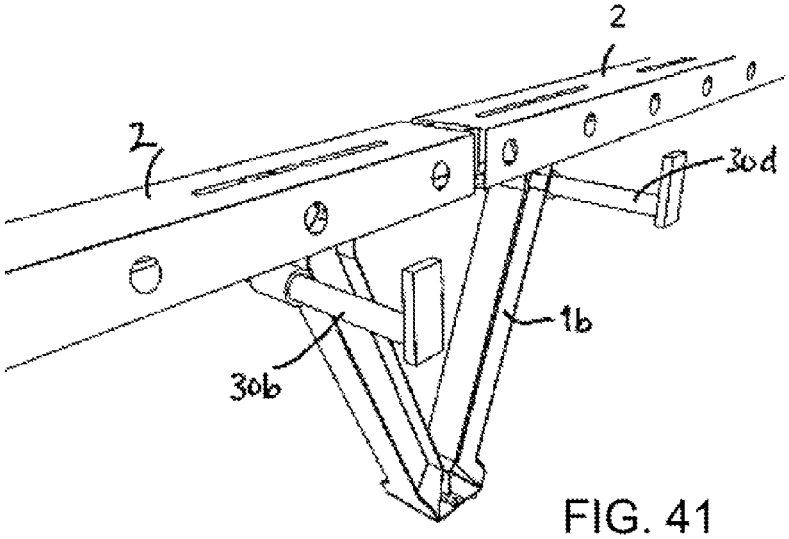
FIG. 41 shows the support in situ.

In an alternative preferred embodiment of the invention illustrated in FIGS. 38 and 39 the services conduit support hanger may be formed as a saddle 40 having a channel 40*a* in a lower in use face and sidewalls 40*b*, 40*c* to sit and fit closely astride the top and sides of the beam/spanning element 2 to hang therefronl The saddle 40 and its channel 40*a* of the hanger are slidable along the spanning element/beam 2 for the hanger to be positionally adjustable along the length of the beam 2. The sidewalls 40*b*, 40*c* of the saddle 40 replace the stem 31 of the hanger 30 of the preceding embodiments. Each of the sidewalls 40*b*, 40*c* is at its lower end turned out/bent to extend horizontally outwardly relative to the beam 2 to define a support arm/ledge portion 41. The support arm/ledge portion 41 of the sidewalls 40*a*, 40*b* thus replaces the rod/bar type support arms 30*a-d* of the preceding embodiments. Alternatively this embodiment could also have rod/bar type support arms 30*a-d*, but it is preferable that the sidewalls be turned to form the arms since this provides for a simple, low cost means of production of the hangers, eg pressed/formed from sheet steel.

In FIGS. 40 to 43 the bifurcated/triangular form raised floor support leg has two sets of conduit support arms mounted on the support leg, one set on each limb of the bifurcated leg and at a position below the level of the platform part 4. The conduit support arms are thus at a level that is substantially below the level of the raised floor, allowing for sturdy and stable operation in carrying of cables or even relatively large pipe-work below the raised floor and without need for any additional extension mounted on top of the leg to raise the floor above the leg. The support arms are de-mountable from the stem 31, the stem 31 having a respective socket/through-hole 34 into which a support arm 30*a* mounts. The illustrated arm 30*a* can be projected through the through hole 34 until it is extending equidistantly from one side and the other, obviating need for a pair of separate opposing arms. This support leg with integral support arm mounts may be used as a primary support for pipes and cables but preferably is used in combination with the beam-mounted support hangers 30 of the preceding and subsequent embodiments. Although illustrated with only a single tier of support arms 30*a*, there particularly preferably are at least upper and lower tiers just as in the preceding embodiments, to enable carrying cables in an upper tier and pipe-work in a lower tier. The single arm 30*a* may be replaced by a pair of arms 30*a*, 30*b* just as in the preceding embodiments, and the arm(s) 30*a* might be integrated in the leg 1*b* if preferred.

By way of a further variation, FIG. 43 shows a single column/pillar-like leg 1*c* that, like the bifurcated leg 1*b* of FIG. 42, may be used to carry a support arm 30*a* extending through a socket/through hole 34 on the leg 1*c*. This too may be provided in a number of variants including: with more than one socket 34 on each face as a multi-tier support; with a pair of back to back sockets 34 rather than a through-hole and thus to receive a pair of arms 30*a*, 30*b;* and/or may have two sets of support arms at each level.

Referring to FIG. 44 this show a raised floor support leg that has an integral extension foot 3*a* that may be adjusted to adjust the height of the leg. The foot may be screwed up or down to raise or lower the height of the leg.

Referring to FIGS. 45 and 46, in this embodiment the services conduit support hanger 30 here has a head 31 with a pair of grooves 31*a*, 31*b*, one groove on each side, whereby one of the flanges 13 of the beam 2 fits into one of the grooves 31*a* and the other flange 13 fits into the other of the grooves 31*b* to provide a relatively more rigid fixture of the services conduit support hanger 30 to the beam 2.

The invention is not limited to the embodiments above-described and features of any of the embodiments may be employed separately or in combination with features of the same or a different embodiment and all combinations of features to produce a loft raised flooring or a raised conduit support system within the spirit and scope of the invention.

The invention claimed is:

1. A loft flooring system installed in a loft and that comprises:

a plurality of bridging supports each bridging between a substantially parallel pair of joists of the loft floor and each bridging support having a first upright leg with a foot mounted onto a first of the joists and a second upright leg with a foot mounted onto a second of the joists, and a spanning element therebetween over which flooring boards or flooring panels are laid with the flooring boards or flooring panels resting on the spanning element, the spanning element extending between an upper end of the first leg and an upper end of the second leg and thereby spanning over a void between the pair of joists, each bridging support is an assembly whereof each leg is separate and the spanning element is a separate beam that is mounted on top of the legs to span between the joists, the bridging supports being assembled connected in a row by the spanning elements to provide a support assembly extending in a direction transverse to the joists with the flooring boards or panels laid thereon, wherein each bridging support forms a bridge over the joists at a height above the joists with a void between the legs that is contiguous with a void/channel between the joists so that insulation laid between the joists is not compacted by the bridging support.

2. The loft flooring system as claimed in claim 1, wherein the flooring system is installed as a plurality of rows each traversing the joists, the rows being parallel to each other and the rows having no supportive spanning element or other structural member below the floor panels or boards linking from one row to the next.

3. The loft flooring system as claimed in claim 2, wherein each leg has at its top a platform on which the beam rests.

4. The loft flooring system as claimed in claim 3, wherein the platform projects towards the other leg.

5. The loft flooring system as claimed in claim 4, wherein the platform projects over said void/channel between the joists.

6. The loft flooring system as claimed in claim 4, wherein the spanning element has a channel-shaped/U-shaped profile with sidewalls and mounts inverted onto the platform with the channel facing downward engaging the platform.

7. The loft flooring system as claimed in claim 4, wherein one stem supports a first end of the platform while another stem supports a second end of the platform.

8. The loft flooring system as claimed in claim 2, wherein the foot of the first and/ or second upright leg is formed with a right-angled bracket that fits to a top surface and a sidewall of the joist.

9. The loft flooring system as claimed in claim 8, wherein the bracket is provided with a channel profile to fit not only to a top surface and a sidewall of a said joist but to the opposing sidewall too as a saddle whereby the fit of the bracket to that joist limits or substantially prevents movement of the bridging support in the direction orthogonal to the joists.

10. The loft flooring system as claimed in claim 1, wherein each leg has a foot that extends from the leg in at least one axial direction along the corresponding joist to which it is mounted.

11. The loft flooring system as claimed in claim 10, wherein each leg has a foot that extends from the leg in both axial directions along the corresponding joist to which it is mounted.

12. The loft flooring system as claimed in claim 1, wherein the spanning element is formed as a rigid elongate member that sits or otherwise mounts at one end on top of the first leg and at the other end on top of the second leg.

13. The loft flooring system as claimed in claim 1, wherein each leg has at least two stems each extending between the foot of the leg and the top of the leg, the leg being bifurcated, splitting into two diverging stems at or near the foot.

14. The loft flooring system of claim 1, wherein at least one of the first leg and second leg has an approximately T-shaped form or I-shaped form, as viewed in section.

15. The loft flooring system as claimed in claim 1, wherein a said bridging support comprises a first leg having a foot that is wholly of plastics.

16. The loft flooring system as claimed in claim 1, wherein the spanning element has male or female sliding engagement means for sliding inter-engagement with complementary sliding engagement means on each of the first leg and second leg, the sliding inter-engagement being transverse to the joists.

17. The loft flooring system as claimed in claim 16, wherein the male sliding engagement means comprises a flange, while the female sliding engagement means comprises a corresponding slot.

18. The loft flooring system as claimed in claim 1, wherein the top of each leg that defines a surface on which the spanning element mounts is formed with a recess into which a nail or other fixing may be driven so that the spanning element may be tightened down there-onto, compressing into the recess.

19. The loft flooring system as claimed in claim 1, wherein the system further comprises an elongate fitting tool having a bar with spaced apart elements along its length at intervals that define the spacing of the feet of the rows along each joist.

20. The loft flooring system as claimed in claim 1, wherein the spanning element has an upwardly facing channel thereon that carries at least one of electrical cabling and pipes therein.

21. The loft flooring system as claimed in claim 20, wherein the upwardly facing channel has a cover with a fascia incorporating at least one of an electrical power outlet and lighting.

22. The loft flooring system as claimed in claim 1, wherein the flooring system accommodates inter-row fitting storage containers that take advantage of the space between rows of fitted spanning, elements to provide a parking zone for the containers and comprises a set of rigid edge-support shelves that are hung spanning between two adjacent rows of the fitted spanning elements, the edge support shelves being hung spaced apart to define an opening therebetween through which the base of the storage container extends and being configured supporting and constraining in place co-operating rebated bottom edges of the storage containers.

23. The loft flooring system as claimed in claim 1, wherein the system further comprises a services conduit support hanger that is engaged with and hung from the spanning element and which carries at least one of a pipe and cables.

24. The loft flooring system as claimed in claim 23, wherein the spanning element is an elongate beam with a channel extending therealong and the services conduit support hanger is slidingly engaged within the channel of the beam to hang therefrom and is slidable along the channel to be positionally adjustable along the length of the beam.

25. The loft flooring system as claimed in claim 24, wherein the beam has a lateral flange along each longitudinal edge of the channel whereby each flange projects towards the other over the channel.

26. The loft flooring system as claimed in claim 25, wherein the services conduit support hanger has a stem and a head that is larger than the stem and whereby the head is adapted to be held in the channel by the lateral flanges.

27. The loft flooring system as claimed in claim 25, wherein the services conduit support hanger has a pair of grooves with one groove on each side, whereby one of the flanges fits into one of the grooves and the other flange fits into the other of the grooves.

28. The loft flooring system as claimed in claim 23, wherein the services conduit support hanger comprises a stem having at least one support arm thereon projecting laterally therefrom and where the arm provides a support ledge on which pipe-work or cabling is carried.

29. The loft flooring system as claimed in claim 28, wherein the services conduit support hanger has a pair of support arms arranged with each arm extending from each opposing side of the stern or one arm that projects from each opposing side of the stem.

30. The loft flooring system as claimed in claim 28, wherein the at least one support arm is mounted to the stern, the stem having a socket into which the support arm mounts.

31. The loft flooring system as claimed in claim 28, wherein the services conduit support hanger comprises at least a first support arm or pair of support arms at a first level along the stem and a second arm or pair of support arms at a second level further down the length of the stem.

32. The loft flooring system as claimed in claim 31, wherein the second support arm or pair of support arms is/are longer than the first support arm or pair of support arms.

33. The loft flooring system as claimed in claim 23, wherein the hanger is formed as a saddle having a channel in a lower in use face with sidewalls to fit astride the top and sides of a said spanning element to hang therefrom and the saddle being slidable along the spanning element for the hanger to be positionally adjustable along the length of the spanning element.

* * * * *